United States Patent [19]

Kuriki et al.

[11] 4,426,516

[45] Jan. 17, 1984

[54] POLYESTER FIBER DYEABLE UNDER NORMAL PRESSURE

[75] Inventors: Tomio Kuriki, Katano; Seiichi Manabe, Ibaraki, both of Japan

[73] Assignee: Asahi Kasei Kogyo Kabushiki Kaisha, Osaka, Japan

[21] Appl. No.: 363,628

[22] Filed: Mar. 30, 1982

[30] Foreign Application Priority Data

| | | | |
|---|---|---|---|
| Mar. 31, 1981 | [JP] | Japan | 56-46407 |
| Mar. 31, 1981 | [JP] | Japan | 56-46408 |
| May 14, 1981 | [JP] | Japan | 56-71358 |
| May 14, 1981 | [JP] | Japan | 56-71360 |

[51] Int. Cl.[3] ..... C08G 63/70

[52] U.S. Cl. ..... 528/272; 528/308.1; 528/308.2

[58] Field of Search ..... 528/272, 309, 308.1, 528/308.2

[56] References Cited

U.S. PATENT DOCUMENTS

| | | | |
|---|---|---|---|
| 3,527,862 | 9/1970 | Shimosako et al. | 264/289.6 |
| 3,748,844 | 7/1973 | Pacofsky | 528/272 |
| 4,041,689 | 8/1977 | Duncan et al. | 528/272 |
| 4,076,783 | 2/1978 | Yasuda et al. | 264/78 |
| 4,134,882 | 1/1979 | Frankfort et al. | 528/308.2 |
| 4,156,071 | 5/1979 | Knox | 528/272 |
| 4,237,261 | 12/1980 | Kawamura et al. | 528/272 |
| 4,251,481 | 2/1981 | Hamlyn | 264/210.3 |

FOREIGN PATENT DOCUMENTS

| | | |
|---|---|---|
| 2741193 | 3/1979 | Fed. Rep. of Germany . |
| 684046 | 12/1952 | United Kingdom . |
| 735171 | 8/1955 | United Kingdom . |
| 903913 | 8/1962 | United Kingdom . |
| 2002680A | 2/1979 | United Kingdom . |

*Primary Examiner*—Lucille M. Phynes

*Attorney, Agent, or Firm*—Finnegan, Henderson, Farabow, Garrett & Dunner

[57] ABSTRACT

A fiber consisting essentially of polyethylene terephthalate capable of being dyed under normal pressure and having an initial modulus at 30° C. of about 55 g/d to about 130 g/d, a relationship between a peak temperature ]$T_{max}$ (°C.)] at the peak of a dynamic mechanical loss tangent (tan δ) measured with a frequency of 110 Hz and a peak value of the dynamic mechanical loss tangent [(tan δ)$_{max}$] represented by the formula:

$$(\tan\delta)_{max} \leqq 1 \times 10^{-2} (T_{max} - 105)$$

and a (tan δ)$_{max}$ of about 0.14 to about 0.30 and a dynamic mechanical loss tangent at 220° C. (tan $\delta_{220}$) of at most about 0.055. The fiber is produced by subjecting a polyethylene terephthalate fiber obtained at a spinning speed of at least about 4000 m/min. to heat treatment at a temperature ranging from a temperature at which a dynamic modulus (E') of the fiber deviates from a tangent line at 180° C. of a logarithm of the E' of the fiber-temperature curve ($T_{min}$) plus 10° C. to a temperature of completion of melting ($T_{m3}$) at a melting curve of the fiber measured by a differential scanning calorimeter (DSC) plus 10° C.

9 Claims, 15 Drawing Figures

Fig. 11a
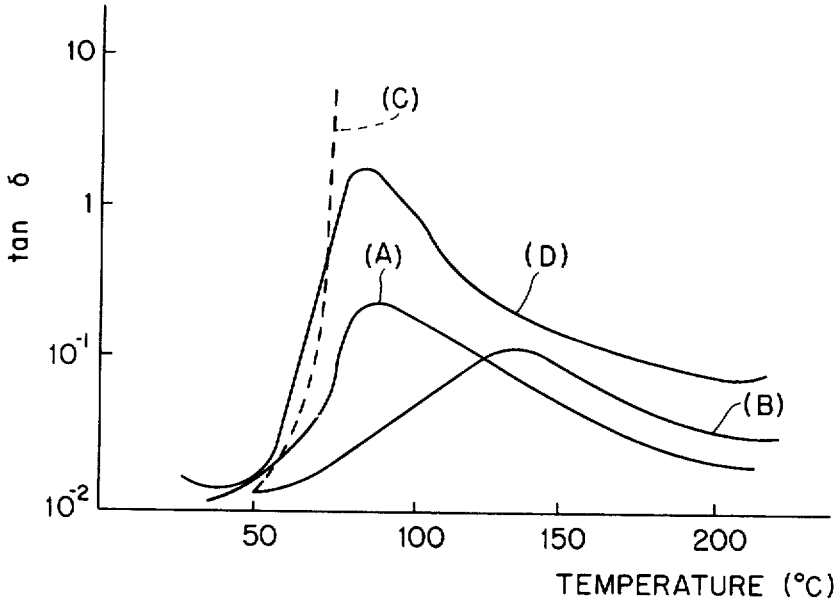
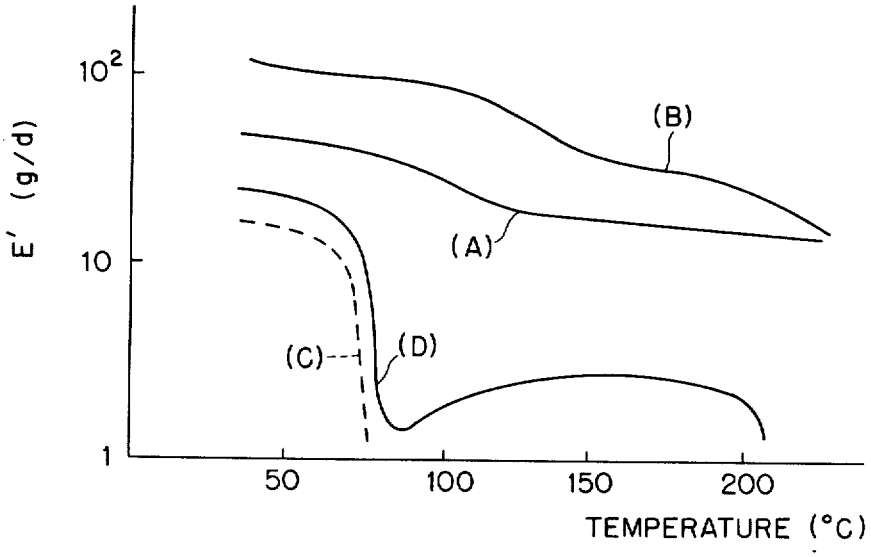
Fig. 11b

POLYESTER FIBER DYEABLE UNDER NORMAL PRESSURE

BACKGROUND OF THE INVENTION

The present invention relates to improved polyester fibers including flat yarns, tows, staple fibers and false twist yarns. More particularly, the invention relates to polyester fibers capable of being dyed with disperse dyes under normal pressure, having excellent color fastness and still having sufficient mechanical properties for practical use.

Generally polyester fiber, especially polyester fiber consisting essentially of polyethylene terephthalate, has many excellent properties such as tenacity, dimensional stability, thermal resistance and wash and wear property and many varied uses. On the other hand, polyethylene terephthalate fibers are poor in dyeability and it is therefore necessary to dye them under the conditions of a high temperature, e.g., about 130° C., and a high pressure. Consequently, the production of such fibers suffers from the disadvantages that a special apparatus is required for dyeing. Moreover, use of such fibers in admixture with fibers such as wool, acrylic fibers and spandex fibers whose physical properties deteriorate upon dyeing under a high pressure and a high temperature, is limited.

Various improvements in dyeability of polyethylene terephthalate fibers under normal pressure have been proposed. A process in which accelerating agents called as carriers are employed in dyeing, for example, is known. However, the process has many disadvantages. More specifically, such carriers which are irritative and harmful to human body worsen working environmental sanitation at a dyeing factory and have difficulty in disposal of dyeing waste. Further uneven dyeing called as a carrier spot may be caused due to insufficiency of emulsification of the carriers and the carriers may remain in a dyed article to deteriorate the color fastness to light of the dyed article. Moreover, the carrier dyeing causes changes in the mechanical properties of the polyethylene terephthalate fiber such as a decrease in the tenacity and an increase in the elongation.

A copolymer of polyester with a compound having a metal sulfonate group or polyether has been considered a polyethylene terephthalate having an improved dyeability. Although such modified polyesters improve the dyeability, it is difficult to polymerize and spin them and the cost of the starting materials increases or the excellent mechanical and thermal properties possessed by polyethylene terephthalate and the color fastness may deteriorate. Consequently, the improvement in the dyeability resulting from such chemical modification detrimentally affects the inherent excellent thermal resistance and mechanical properties of polyethylene terephthalate, since the improvement is achieved by introducing a third component which can act as a dye receptacle for dyeing the polymer.

SUMMARY OF THE INVENTION

An object of the present invention is to provide a polyester fiber consisting essentially of polyethylene terephthalate having sufficient mechanical and thermal properties for practical use and capable of being dyed under normal pressure, especially with a disperse dye without using a carrier.

Another object of the present invention is to provide a process for producing such a polyester fiber.

Additional objects and advantages of the invention will be set forth in the description that follows, and in part will be obvious from the description, or may be learned by practice of the invention. The objects and advantages of the invention may be realized and attained by means of the instrumentalities and combinations particularly pointed out in the appended claims.

To achieve the foregoing objects and in accordance with the purpose of the invention, as embodied and broadly described herein, the polyester fiber of the present invention consists essentially of polyethylene terephthalate capable of being dyed under normal pressure and having an initial modulus of at 30° C. of about 55 g/d to about 130 g/d, a relationship between a peak temperature [$T_{max}$ (°C.)] at the peak of a dynamic mechanical loss tangent (tan δ) measured with a frequency of 110 Hz and a peak value of the dynamic mechanical loss tangent [$(\tan \delta)_{max}$] represented by the formula:

$$(\tan \delta)_{max} \geqq 1 \times 10^{-2} (T_{max} - 105)$$

and a $(\tan \delta)_{max}$ of about 0.14 to about 0.30 and a dynamic mechanical loss tangent at 220° C. ($\tan \delta_{220}$) of at most about 0.055.

Further to achieve the foregoing objects and in accordance with the purpose of the invention, as embodied and broadly described herein, the process of the present invention for producing such a polyester fiber comprises subjecting a polyethylene terephthalate fiber obtained at a spinning speed of at least about 4000 m/min. to heat treatment, at a temperature ranging from a temperature at which a dynamic modulus (E') of the fiber deviates from a tangent line at 180° C. of a logarithm of the E' - temperature curve ($T_{min}$) plus 10° C. to a temperature of completion of melting ($T_{m3}$) at a melting curve of the fiber measured by a differential scanning calorimeter (DSC) plus 10° C.

The accompanying drawings, which are incorporated in and constitute a part of this specification, illustrate the invention and, together with the description, serve to explain the principles of the invention.

BRIEF DESCRIPTION OF THE DRAWING

In FIGS. 1 and 2 arrows show the direction of running filaments 1.

FIGS. 11(*a*) and 11(*b*) are graphs illustrating a dynamic mechanical loss tangent(tan δ) - temperature(T) curve and a dynamic modulus (E') - temperature(T) curve, respectively, in which (A) represents a fiber of this invention, (B) represents a conventional drawn fiber, (C) represents an undrawn fiber and (D) represents a partially oriented fiber.

DESCRIPTION OF THE PREFERRED EMBODIMENTS

Figure 1:
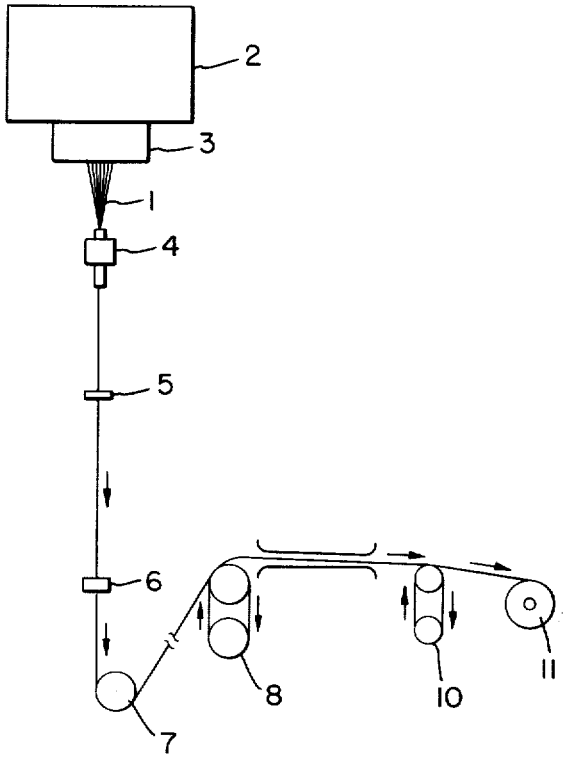
FIG. 1 is a diagram illustrating one embodiment of an apparatus employed in the process of the present invention, in which the numbered elements are as follows: 1, extruded filaments; 2, a spinhead with a nozzle; 3, a cylindrical heating zone; 4, aspirator; 5, a device for providing an oiling agent; 6, a device for bundling; 7, a take-up roller; 8, a pair of feed rollers; 9, a heater for heat treatment; 10, a pair of delivery rollers; and 11, a winder.

Reference will now be made in detail to the presently preferred embodiments of the invention, examples of which are illustrated in the accompanying drawings.

As a result of a study on the fine structure of polyethylene terephthalate fibers, it has been found that only a polyethylene terephthalate fiber having a specific amorphous structure could overcome the disadvantages of the conventional fibers and that only a polyethylene terephthalate fiber having a specific amorphous structure has a dyeability under normal pressure and an excellent color fastness in addition to the suitable inherent properties of polyethylene terephthalate fibers.

The polyester fiber of this invention consists essentially of polyethylene terephthalate and characteristically satisfies the following three conditions:

(I) The initial modulus at 30° C. is about 55 g/d to about 130 g/d.

(II) The relationship between a peak temperature [$T_{max}$(°C.)] at the peak of a dynamic mechanical loss tangent (tan δ) measured with a frequency of 110 Hz and a peak value of the dynamic loss tangent [(tan δ)$_{max}$] is represented by the formula:

$$(\tan\delta)_{max} \geqq 1\times10^{-2}(T_{max}-105)$$

and the (tan δ)$_{max}$ is about 0.14 to about 0.30.

(III) The dynamic mechanical loss tangent at 220° C. is at most about 0.55.

The polyethylene terephthalate which can be employed in this invention can be prepared by any conventional methods and may be a copolymer with a small amount of a comonomer, i.e., at most about 5% by weight so as not to adversely affect the properties of polyethylene terephthalate. The degree of polymerization of the polyethylene terephthalate employed is not particularly limited and may be within a general range capable of forming fibers. The polyethylene terephthalate employed may also contain conventional additives for polyester fibers such as a delustering agent, a stabilizer and an antistatic agent.

A most characteristic feature of the polyethylene terephthalate fiber according to this invention resides in the above described conditions (I) and (II).

As a result of a study on the relationship between the fine structure of an amorphous region of a polyethylene terephthalate fiber and the dyeability, it has been found that in order for the polyethylene terephthalate fiber to have a dyeability under normal pressure, the fiber is required to fulfill the above described condition (I) and the above described condition (II) which represents a small transformation of the fine structure of the fiber at heating, i.e., a high thermal stability of the fine structure.

In this invention the dyeability under normal pressure means that the dye absorption at 100° C. of a polyethylene terephthalate of this invention is the same as or greater than that of the conventional polyethylene terephthalate fiber at 130° C. under a pressure higher than atmospheric.

There are several studies reported on the relationship between the dyeability of a fiber with a disperse dye and viscoelasticity of the fiber [e.g., Kenji Kamide and Seiichi Manabe, "Fine Structure of Amorphous Region of Fiber Revealed by Dynamic Dispersion", Sen-i Gakkaishi, 34, p70 (1978)]. According to these studies it is generally considered that with greater tan $\delta$ values relating to a mechanical absorption due to the micro-Brownian movement of a main chain of fiber or with lower temperature positions at the mechanical absorption, the dyeability of the fiber more increases. On the other hand, it has been considered that with greater tan $\delta$ values the mechanical properties deteriorates and the thermal resistance from the viewpoint of the mechanical properties decreases. However, it is known that regarding a polyethylene terephthalate fiber at a tan $\delta$ value higher than a specific value, i.e., usually 0.13 or more the dyeability of the fiber reversely decreases with increased tan $\delta$ values. Accordingly the peak value $(\tan \delta)_{max}$ at a tan $\delta$-temperature curve for a polyethylene terephthalate fiber practically employed in forming clothing is less than about 0.14. Even if polyethylene terephthalate fibers having a $(\tan \delta)_{max}$ of about 0.14 or more may be obtained by conventional methods, the fibers are not rendered dyeable under normal pressure since the above described condition (II) is not fulfilled. As a result of a study on the relationship between the above described condition (II) and the dyeability it has now been found that a conventional polyethylene terephthalate fiber having a $(\tan \delta)_{max}$ of about 0.14 or more undergoes a structural transformation in a dyeing procedure and changes to a fiber having a $(\tan \delta)_{max}$ less than 0.12 and a $T_{max}$ more than 115° C. and resultedly the dyeability of the fiber under normal pressure become impossible.

Further if the polyethylene terephthalate fiber having the above described fine structure, i.e., satisfying the condition (II) does not possess an initial modulus at 30° C. of about 55 g/d or less, the fiber loses the suitable inherent mechanical properties of polyester fibers, and the crease resistance and the dimensional stability as a final article decrease.

The conventional polyethylene terephthalate fiber obtained at a spinning speed less than 3000 m/min. and then not drawn possesses the fine structure of the above described condition (II) but the fine structure at heating greatly transforms, i.e., the tan $\delta_{220}$ is more than 0.055 and at the same time the initial modulus at 30° C. is less than 55 g/d. Thus this fiber is not dyeable under normal pressure. Also the polyethylene terephthalate fiber obtained at a spinning speed less than 3000 m/min. and then drawn possesses an initial modulus at 30° C. of 55 g/d or more but does not possess the fine structure of the above described condition (II), and the $T_{max}$ is around 130° C. and the $(\tan \delta)_{max}$ is 0.10, and it is impossible to dye this fiber under normal pressure. Accordingly, the polyethylene terephthalate fulfilling the above described conditions (I), (II) and (III) in the present invention is novel.

It is appropriate to employ the above described $T_{max}$ and $(\tan \delta)_{max}$ as the particular values representing the fine structure of an amorphous region of fiber. The $T_{max}$ is usually positioned at 50° C. above the glass transition temperature and the $(\tan \delta)_{max}$ relates to the amount of a molecular chain in the amorphous region whose thermal movement is activated at a temperature of the $T_{max}$. The $T_{max}$ and $(\tan \delta)_{max}$ of this invention are values relating to a dynamic absorption, i.e., $\alpha_a$ absorption appearing due to the micro-Brownian movement of a molecular chain in the amorphous region.

Regarding the polyethylene terephthalate fiber, only from the viewpoint of dyeability the fiber is rendered more easily dyeable with increased (tan $\delta$) values or with decreased $T_{max}$ values. However, it is necessary that the fiber satisfies at least the above described condition (II) in order to be dyeable under normal pressure. Especially when the polyethylene terephthalate fiber not undergoing false twisting has a $T_{max}$ of about 105° C. or less and a $(\tan \delta)_{max}$ of about 0.14 or more, the dyeability of the fiber is excellent.

On the other hand, as discussed below the false twist polyethylene terephthalate fiber undergoes heat treatment in false twisting and the structure of the fiber is stabilized and as a result, the fiber nearly satisfies the above described condition (III). Consequently the range of the $T_{max}$ and $(\tan \delta)_{max}$ fulfilled by the false twist fiber capable of being dyed under normal pressure becomes broader than that of the fiber not undergoing false twisting.

Details will be firstly given of the fiber not undergoing false twisting and secondly of the false twist fiber.

As a result of a study on the relationship between the fine structure of a fiber and the dyeability, it has been found that with the conventional polyethylene terephthalate fiber having a $T_{max}$ of 120° C. or more, if the $(\tan \delta)_{max}$ is 0.14 or more, the thermal stability of the fiber structure decreases and the color fastness as well as the dimensional stability decreases. However, with the polyethylene terephthalate fiber having an initial modulus at 30° C. of at least about 55 g/d and a $T_{max}$ of at most about 115° C., even if the $(\tan \delta)_{max}$ is 0.14 or more, it is not necessarily observed that the thermal stability and the dimensional stability of the fiber tend to decrease. Especially when the $T_{max}$ is about 105° C. or lower, with polyethylene terephthalate not undergoing false twisting, in some cases the thermal stability of the fiber structure rather increases with increased $(\tan \delta)_{max}$ values and this tendency of the stabilization of the fiber structure is remarkable when the $T_{max}$ is about 100° C. or lower. The thermal stability of the fiber structure relates to a dynamic mechanical loss tangent at 220° C. ($\tan \delta_{220}$) and increases with smaller $\tan \delta_{220}$ values. When the $\tan \delta_{220}$ becomes smaller, the decrease in the initial modulus accompanying a rise in temperature becomes smaller. Especially when the $\tan \delta_{220}$ is about 0.055 or less, the decrease in the initial modulus extremely become small, that is, the fiber structure become very stable to heat.

Thus, the polyethylene terephthalate fiber of this invention which satisfy the above described conditions (I), (II) and (III) can be dyed under normal pressure without decrease in the thermal stability, dimensional stability and mechanical properties of the fiber and at the same time without decrease in the color fastness of the fiber. It is generally observed that when the $(\tan \delta)_{max}$ is 0.30 or more, the thermal stability decreases the fiber does not satisfy the above described condition (III).

As described above, the polyethylene terephthalate fiber not undergoing false twisting according to this invention is required to have an initial modulus at 30° C. of at least about 55 g/d. For this reason the mean birefringence index ($\Delta n$) in this invention is typically about $35\times10^{-3}$ or more. The initial modulus at 30° C. in this invention means a dynamic modulus at 30° C. ($E'_{30}$) and its measuring method is described below. In order to impart excellent mechanical properties and thermal stability to the fiber in accordance with an increase in $(\tan \delta)_{max}$, it is necessary to increase the $E'_{30}$. When the $E'_{30}$ is less than about 55 g/d, the thermal stability of the fiber structure and dimensional stability of the fiber as well decrease and as a result, the fiber becomes too soft.

As a result of a study on the relationship among the structure of the polyethylene terephthalate fiber having the above described characteristic features and not undergoing false twisting according to this invention, the mechanical properties such as tenacity, elongation, initial modulus and dynamic modulus and the dyeability, the following has been found.

Degree of crystallinity ($\chi c$), apparent crystal size at the (010) face (ACS) and degree of crystal orientation at the (010) face (CO) are all related to mechanical properties of the polyethylene terephthalate fiber not having been subjected to false twisting according to this invention. In this invention it is preferred that the $\chi c$ is about 70% to about 90%, the ACS is about 50 Å to about 85 Å and the CO is about 85% to about 97%, so that the fiber of this invention has suitable properties for use in forming clothing such as a tenacity of at least about 3 g/d, an elongation of about 20% to about 60% and an initial modulus of about 55 g/d to about 130 g/d. The $\chi c$, ACS and CO of the present invention are measured by X-ray diffraction discussed below.

Further, when a mean refractive index $[n_{\parallel(0)}]$ at the center of a fiber by polarized light having an electric field vector in the direction of the axis of the fiber is at least about 1.65, the polyethylene terephthalate fiber not undergoing false twisting has a suitable elongation of about 20% to about 60% and dyeability, and is desirable for use in forming clothing.

In order that the polyethylene terephthalate fiber not undergoing false twisting according to this invention has an initial modulus at 30° C. of at least 55 g/d, the mean birefringence index ($\Delta n$) in the present invention is preferably at least about $35\times10^{-3}$. The mean birefringence index ($\Delta n$) is preferably at least about $80\times10^{-3}$ from the viewpoint of thermal stability of the structure and is preferably at most $150\times10^{-3}$ from the viewpoint of dyeability and color fastness. When the $\Delta n$ is about $150\times10^{-3}$ or less, the rate of decrease of dynamic modulus (E') at between 150° C. and 220° C., represented as $E'_{220}/E'_{150}$: $E'_{220}$, (E') at 220° C.; $E'_{150}$, (E') at 150° C., becomes 0.7 or more, i.e., the structure of the fiber is stabilized against heat and color fastness increases.

Furthermore, when the mean refractive index $[\Delta_{\parallel}(0.8\text{–}0)]$ between the mean refractive index at the center of the cross section of a fiber $[n_{\parallel(0)}]$ and the refractive index at a position 0.8 times from the center of the cross section of a fiber $[n_{\parallel(0.8)}]$ or $[n_{\parallel(-0.8)}]$ is within the range as set forth below, and the local mean refractive index is distributed symmetrical around the center of the cross section of the fiber, the fiber has sufficient tenacity, and is improved in uneven dyeing and uneven strength and elongation.

A local mean refractive index distributed symmetrical around the center of the cross section of a fiber means that a minimum value of the mean refractive index ($n_{\parallel}$) is at least about $[n_{\parallel(0)}-1\times10^{-3}]$ and that the difference between the $n_{\parallel(-0.8)}$ and the $n_{\parallel(0.8)}$ is at most about $50\times10^{-3}$, preferably at most about $10\times10^{-3}$. Values of $n_{\parallel(0)}$, $n_{\parallel(0.8)}$, $n_{\parallel(-0.8)}$, $n_{\parallel(0.8-0)}$ and $\Delta n$ are measured by methods using an interference microscope discussed below.

The polyethylene terephthalate fiber not undergoing false twisting according to this invention can be produced by heat-treating a polyethylene terephthalate fiber spun at a spinning speed of at least about 4000 m/min. by dry or wet heat under the specified conditions as discussed below. The fiber thus obtained completely satisfies both conditions (II) and (III) as described above. For example, the structural modification of the fiber before and after the heat treatment in boiling water at 100° C. for 60 minutes is very small and is within about ±5° C. if represented by a change in the $T_{max}$ and within about ±0.02 if represented by a change in the $(\tan \delta)_{max}$.

On the other hand, when the polyethylene terephthalate fiber obtained at a spinning speed of at least about 4000 m/min. is not heat-treated by dry or wet heat under the specified conditions as discussed below, the structural modification of the fiber after the heat treatment in boiling water at 100° C. for 60 minutes in great and the $T_{max}$ increases by about 10° C. or more and the $(\tan \delta)_{max}$ decreases by about 0.05 or more. Accordingly this fiber has bad thermal stability.

The polyethylene terephthalate fiber having the fine structure as described above and capable of being dyed by a disperse dye under normal pressure can be produced by extruding a melt of a polymer consisting essentially of polyethylene terephthalate at a spinning speed of at least about 4000 m/min. to form a fiber and subjecting the fiber to heat treatment at a temperature at which a dynamic modulus (E') of the fiber deviates from a tangent line at 180° C. of a logarithm of the E' of the fiber-temperature curve ($T_{min}$) plus 10° C. to a temperature of completion of melting ($T_{m3}$) at a melting curve of the fiber measured by a differential scanning calorimeter (DSC) plus 10° C.

A first characteristic feature of this invention resides in the spinning at a spinning speed of at least about 4000 m/min. and up to about 11000 m/min., preferably about 6000 m/min. to about 9000 m/min., more preferably about 8000 m/min. to about 9000 m/min.

The spinning speed of this invention is defined as a linear velocity of a take up roller 7 as shown in FIG. 1. When the spinning speed is less than about 4000 m/min., growth of the crystalline region is insufficient and accordingly the fine structure of the fiber is thermally unstable and dimensional stability at heating is inferior. The dimensional stability at heating and the mechanical properties at high temperatures can be quantitatively evaluated by a dynamic modulus at 220° C. ($E'_{220}$). The $E'_{220}$ is about 1 g/d or less at a spinning speed of 3000 m/min. and further decreases at a spinning speed of less than 3000 m/min. to cause melting among single filaments in the heat treatment after spinning.

Figure 6:
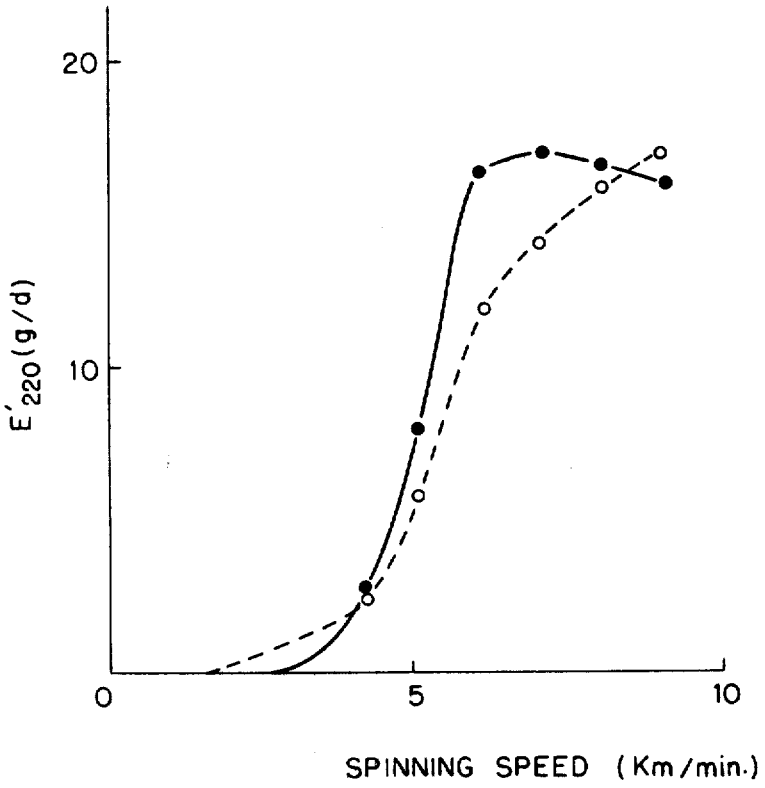
FIG. 6 is a graph illustrating the relationship between a spinning speed and a $E'_{220}$ with respect to a fiber before and after the heat treatment at 245° C. for 1 second at 1% extension, in which a broken line shows the value of the fiber after the heat treatment and a solid line shows that before the heat treatment.
Figure 7:
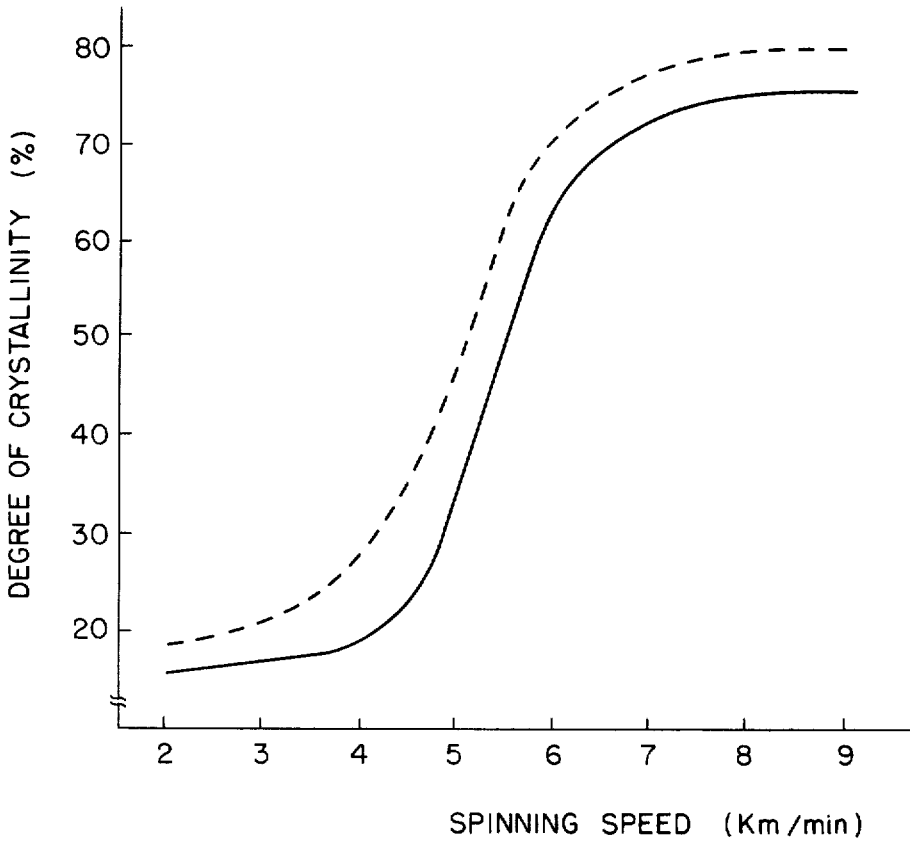
FIG. 7 is a graph illustrating the relationship between a spinning speed and a degree of crystallinity with respect to a fiber before and after the heat treatment under the same conditions as in FIG. 6, in which a broken line shows the value of the fiber after the heat treatment and a solid line shows that before the heat treatment.
Figure 8:
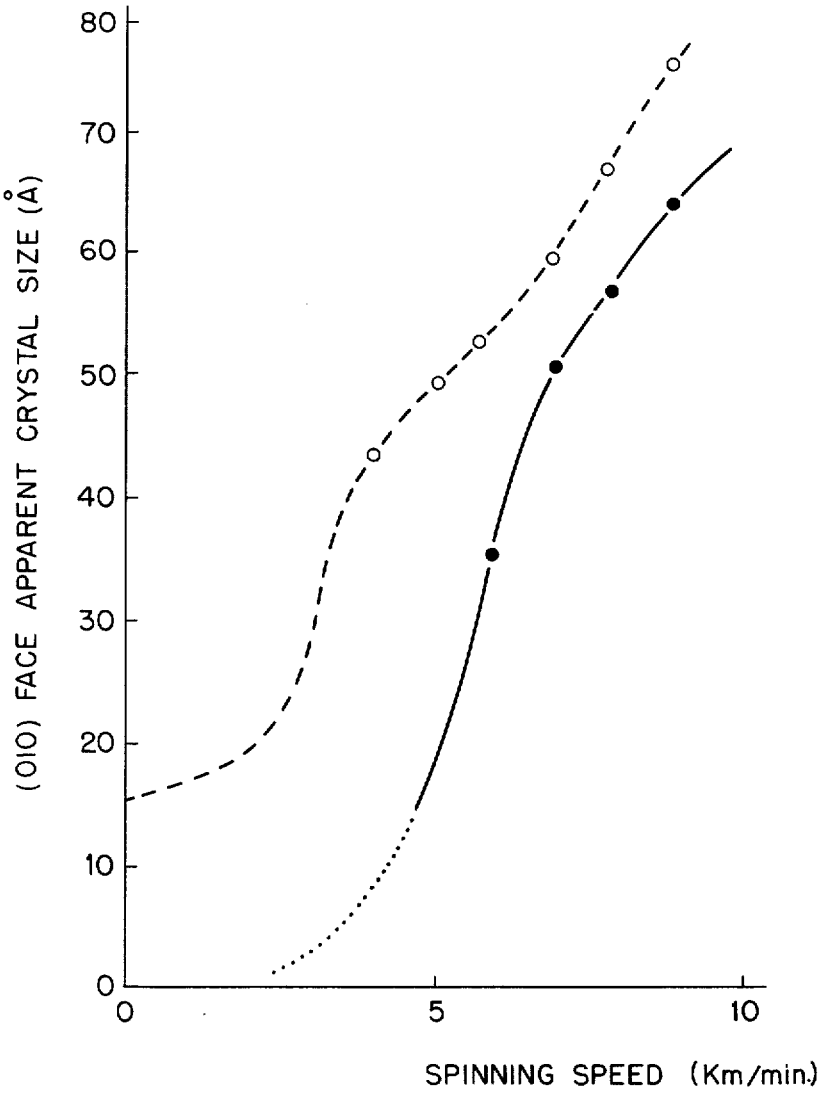
FIG. 8 is a graph illustrating the relationship between a spinning speed and an apparent crystal size at a face of (010) with respect a fiber before and after the heat treatment under the same conditions as in FIG. 6, in which a broken line shows the value of the fiber after the heat treatment and a solid line shows that before the heat treatment.
Figure 9:
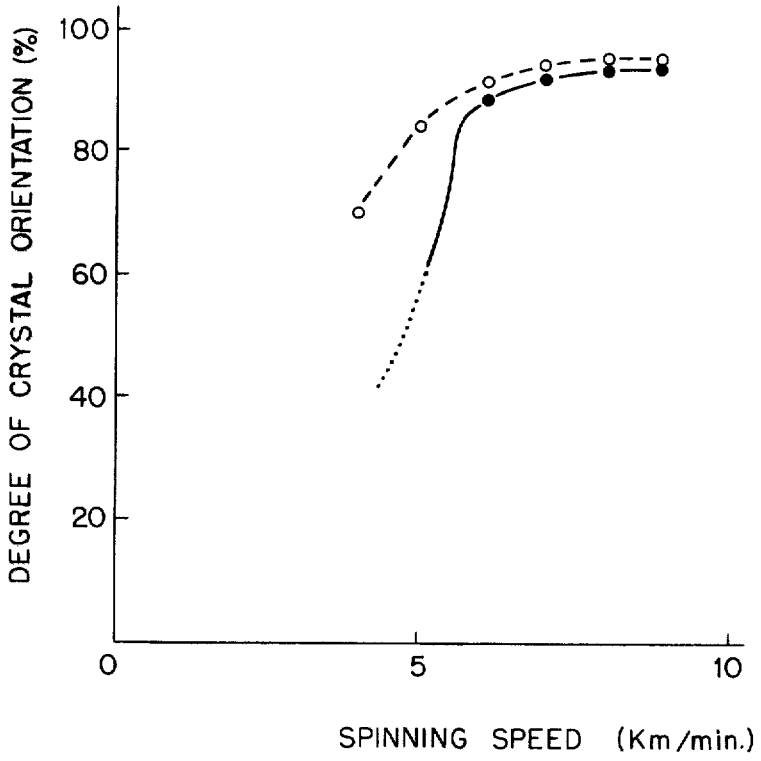
FIG. 9 is a graph illustrating the relationship between a spinning speed and a degree of crystal orientation at a face of (010) with respect to a fiber before and after the heat treatment under the same conditions as in FIG. 6, in which a broken line shows the value of the fiber after the heat treatment and a solid line shows that before the heat treatment.

On the other hand, at a spinning speed of about 4000 m/min. or higher, all the degree of crystallinity, the crystal perfection index and the crystal size of the fiber rapidly increase with increased spinning speeds. As is shown in FIG. 6, the $E'_{220}$ rapidly increases with increased spinning speeds. In FIG. 6, a broken line shows the $E'_{220}$ of a once wound fiber after heat treatment at 245° C. for 2 seconds at 1% extension and a solid line shows the $E'_{220}$ of a once wound fiber before the above described heat treatment. The $E'_{220}$ of a fiber after the heat treatment rapidly increases with increased spinning speeds up to a spinning speed of about 6000 m/min. and at a spinning speed more than 6000 m/min. an increasing ratio of the $E'_{220}$ decreases and at a spinning speed of about 9000 m/min. the $E'_{220}$ after the heat treatment becomes greater than that before the heat treatment. Thus, from the viewpoint of the mechanical properties at high temperatures the spinning speed is preferably at least about 6000 m/min., and more preferably at least about 8000 m/min. FIG. 7 illustrates dependency of a degree of crystallinity of the fiber obtained under the same conditions as in FIG. 6 on a spinning speed, FIG. 8 illustrates dependency of an apparent crystalline size at a face of (010) of the fiber obtained under the same conditions as in FIG. 6 on a spinning speed and FIG. 9 illustrates dependency of a degree of crystal orientation at a face of (010) of the fiber obtained under the same conditions as in FIG. 6. In FIGS. 8 and 9 the region of a dotted line following the left end of the solid line represents impossibility of evaluation.

Thus, as is clear from FIGS. 6 to 9 the degree of crystallinity, the apparent crystal size and the degree of crystal orientation of the fiber increase by the heat treatment at 240° C., and the increase in the degree of crystal orientation of the fibers obtained at a spinning speed of 4000 m/min. and 5000 m/min. by the heat treatment is especially remarkable.

Figure 10:
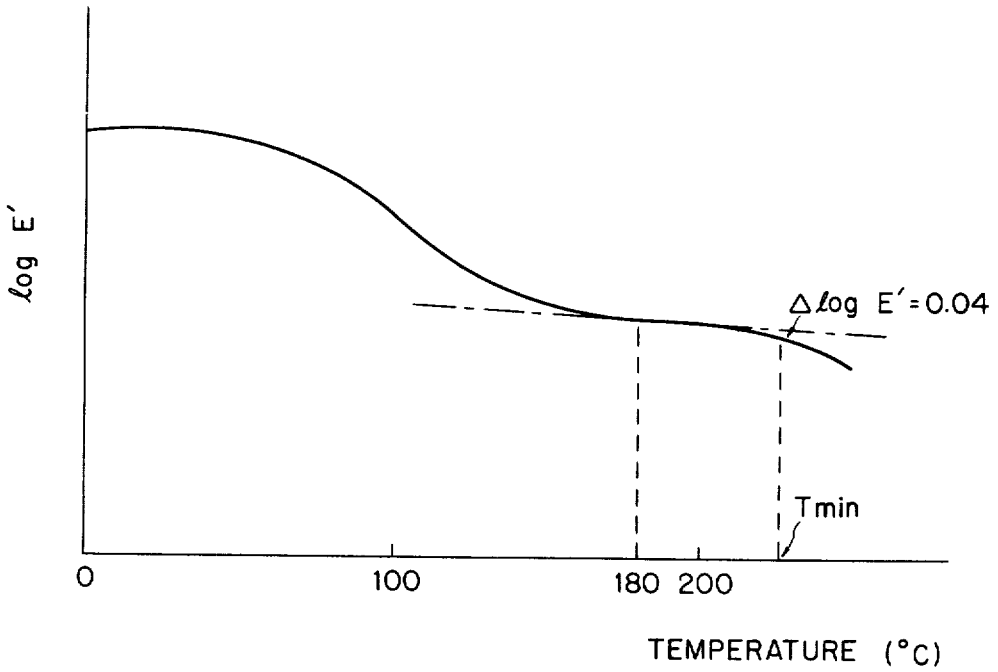
FIG. 10 is a diagram for determining $T_{min}$, in which a tangent line shown as a chain line is drawn at 180° of a log E' - temperature curve and a temperature at which the difference between the tangent line shown as a solid line and the log E' -temperature curve (Δ log E') becomes 0.04 is designated $T_{min}$.

A second characteristic feature of this invention is that the polyethylene terephthalate fiber obtained at a spinning speed of at least about 4000 m/min. is subjected to heat treatment at a temperature ranging from a temperature at which a dynamic modulus (E') of a fiber decreases from a tangent line at 180° C. of a logarithm of the E' of the fiber - temperature curve ($T_{min}$) plus 10° C., i.e., ($T_{min}+10$)°C. to a temperature of completion of melting ($T_{m3}$) at a melting curve of the fiber measured by a differential scanning calorimeter plus 10° C., i.e., ($T_{m3}+10$)°C. The temperature at which the E' decreases from a tangent line at 180° C. of a logarithm of the E'-temperature curve ($T_{min}$) is diagrammatically shown in FIG. 10. In other words, the $T_{min}$ is a temperature at which the difference between the E' of the tangent line and that of the logarithm of the E'-temperature curve becomes 0.9, i.e., the difference in log E' ($\Delta$log E') becomes 0.04. The heat treatment at a temperature lower than ($T_{min}+10$)°C. cannot render the fiber easily dyeable and dyes the fiber in light shade instead. Also the heat treatment at a temperature higher than ($T_{m3}+10$)°C. causes melting among the single filaments, remarkably reduces the $E'_{220}$ and deteriorates the mechanical properties at high temperatures. Further, even if the temperature is adjusted at a temperature lower than ($T_{m3}+10$)°C. in a device or apparatus for heat treatment, melting or uneven dyeing of the fiber is brought about when there is a distribution of temperature in the device or apparatus. Thus it is preferred that the temperature of the device or apparatus for heat treatment employed in this invention is controlled within a predetermined temperature ±0.5° C. and that the gradient of temperature in the device or apparatus for heat treatment is also constant.

It is preferred that the speed of a fiber passing through the device or apparatus for heat treatment is constant. In an extreme case where running of the fiber is stopped, melting of the fibers occurs.

Even when fibers produced by the conventional spinning and stretching steps are subjected to heat treatment at a temperature ranging from ($T_{min}+10$)°C. to ($T_{m3}+10$)°C., the fibers cannot be rendered dyeable under normal pressure and if the heat treatment is conducted without any tension, in addition to about 25% of shrinkage brought about, the $E'_{220}$ extremely decreases and also the mechanical properties decreases. In contrast, when unstretched fibers obtained at a spinning of at least about 4000 m/min. are subjected to heat treatment in the above described temperature range, the fibers can be rendered easily dyeable and at the same time the elongation of the fibers tends to decrease without reduction in the tenacity, and accordingly the fibers change into those having a suitable elongation, i.e., about 10% to about 60% for use in forming clothing. Furthermore, when the unstretched fibers are subjected to heat treatment at a most suitable temperature and a most suitable extension ratio, the fibers can be rendered dyeable under normal pressure and, in addition, the shrinkage in boiling water becomes about 5% or less. On the other hand, when fibers obtained at a spinning speed less than about 4000 m/min. and without going through a stretching step are subjected to the heat treatment, the initial modulus becomes less than about 55 g/d and as a result, the excellent mechanical properties inherently possessed by polyethylene terephthalate remarkably deteriorate.

In order to improve uneven dyeing of a fiber, it is necessary that the temperature of heat treatment is strictly controlled, and it is preferred that the temperature of heat treatment is controlled within a predetermined temperature ±0.5° C.

With increased spinning speeds the $T_{min}$ and $T_{m3}$ increase and the temperature of heat treatment shifts to a higher region. The $T_{min}$ and the $T_{m3}$ approximate to the following equations, respectively.

$$T_{min}=4.8\times10^{-3}(V-4000)+205$$

$$T_{m3}=3.6\times10^{-3}(V-4000)+283$$

wherein V (m/min.) is a spinning speed.

The heat treatment of a fiber at a temperature ranging from ($T_{min}+10$)°C. to ($T_{m3}+10$)°C. obtained at a spinning speed of about 6000 m/min. or more can remarkably render the fiber easily dyeable, and especially the heat treatment of a fiber at a temperature ranging from ($T_{min}+10$)°C. to ($T_{m3}+10$)°C. at an extension ratio higher than about −20% and lower than about +5% can more remarkably render the fiber easily dyeable. The minus (−) sign of the extension ratio means that the fiber is under relaxation and shrinkage and the plus (+) sign of the extension ratio means that the fiber is under tension and elongation.

The dyeability of polyethylene terephthalate fiber obtained at a spinning speed of at least about 4000 m/min. by heat treatment can be more improved when a higher temperature within the range of ($T_{min}+10$)°C. to ($T_{m3}+10$)°C. is employed at the heat treatment and when the period of time for heat treatment becomes longer. When the fiber does not contact the surface of a heater for heat treatment during the heat treatment, it is sufficient that the period of time for heat treatment is at most about 10 seconds. On the other hand, when the fiber contacts the surface of the heater for heat treatment during the heat treatment, any problem cannot be created if there is no difference in relative speed between the fiber and the surface of the heater for example using heating rollers. It is better to avoid employing a method of the heat treatment comprises transferring the fiber in contact with the surface of, for example, a fixed flat plate under heating where there is a difference in relative speed between the fiber and the surface of the heater since fuzz is brought about in the fiber and melting of single filaments and uneven dyeing often occur. In order to shorten the period of time for heat treatment within about one second when the fiber does not contact the surface of the heater, the temperature is preferably about 235° C. or higher.

The device or apparatus for heat treatment which can be employed in this invention may be any device or apparatus capable of heating at a temperature ranging from $(T_{min}+10)$°C. to $(T_{m3}+10)$°C. and its shape is not particularly limited. For example, the polyethylene terephthalate fiber obtained at a spinning speed of at least about 4000 m/min. may be passed through a dryer with hot air whose temperature is controlled within the above described temperature range. Or the polyethylene terephthalate fiber is heat-treated by winding on a cylindrical, rotatable heating roller.

In FIG. 1, a melt of polyethylene terephthalate is extruded from a nozzle (not illustrated) mounted in a spinhead 2 heated at a predetermined temperature, and is cooled in the atmosphere to form filaments 1. In this apparatus a heating zone 3, for example, a heating cylinder surrounding the extruded filaments 1 is provided on the surface of the nozzle, and an aspirator 4 is provided below the heating zone 3 to suck and cool the filaments 1. The filaments passed through the heating zone 3 and the aspirator 4 are treated by a device 5 for providing an oiling agent with the filaments and a device 6 for bundling the filaments, and then are taken up by a take up roller 7. The filaments thus taken up by the take up roller 7 are once wound on the take up roller 7, and then taken out therefrom, passed through a heater for heat treatment 9 whose temperature is appropriately controlled within the above described temperature range while the filaments are elongated or loosened at a suitable extension ratio by a pair of feed rollers 8 and a pair of delivery rollers 10 and wound on a winder 11. Also the filaments 1 are wound on the take up roller 7 one to several times and after the spinning speed is adjusted to about 4000 m/min. or more, by the action of the pair of feed rollers 8 or the pair of delivery rollers 10 the filaments 1 is continuously subjected to heat treatment by the heater for heat treatment 9 and subsequently are wound on a winder 11.

Figure 2:
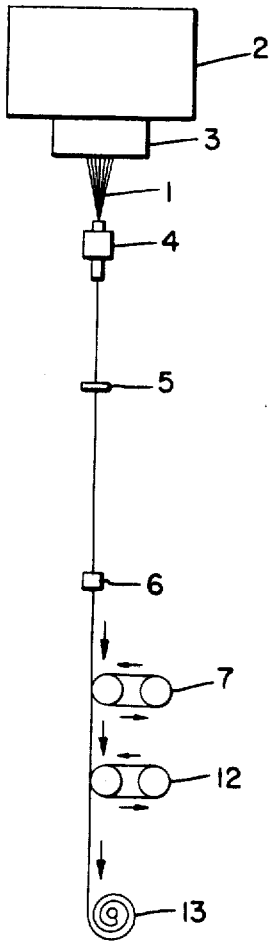
FIG. 2 is a diagram illustrating another embodiment of an apparatus employed in the process of this invention where the spinning step and the heat treatment are continuously carried out, in which the numbered elements 1 to 6 are the same as in FIG. 1 and other numbered elements are as follows: 7, a pair of take-up rollers; 12, a pair of heating rollers; and 13 is a winder.

FIG. 2 is a diagram illustrating another embodiment of an apparatus using a pair of heating rollers by which the spinning step and the subsequently heat treatment step are continuously conducted. In FIG. 2, the number elements 1 to 6 are the same as in FIG. 1 and a melt of polyethylene terephthalate is extruded from a nozzle (not illustrated) mounted in a spinhead 2 heated at a predetermined temperature, and is cooled in the atmosphere to form filaments 1. In this apparatus a heating zone 3, for example, a heating cylinder surrounding the extruded filaments 1 is provided on the surface of the nozzle, and an aspirator 4 is provided below the heating zone 3 to suck and cool the filaments 1. The filaments passed through the heating zone 3 and the aspirator are treated by a device 5 for providing an oiling agent with the filaments and a device 6 for bundling the filaments and then are taken up by a pair of take up rollers 7, wound on the pair of take up rollers 7 one to several times and subsequently wound on a pair of heating rollers 12 for heat treatment one to several times. The surface temperature of the pair of heating rollers 12 is appropriately controlled within the above described temperature range. Then the filaments thus heat-treated are wound on a winder 13. The extension ratio of the filaments at the heat treatment is controlled between the pair of take-up rollers 7 and the pair of heating rollers 12 or between the pair of heating rollers 12 and the winder 13. Further, in order to increase the effect of the heat treatment, the pair of take-up rollers 7 can be replaced by a pair of heating rollers whose surface temperature is adjusted at the same temperature as that of the heating rollers 12.

Thus according to this invention the desired objects of this invention can be achieved by a method comprising extruding a melt of a polymer consisting essentially of polyethylene terephthalate at a spinning speed of about 4000 m/min. or more to form a polyethylene terephthalate fiber, once winding the fiber and subsequently heat-treating the fiber or a method comprising conducting the above described spinning step and the heat treatment step continuously.

Further the fibers which can be subjected to the heat treatment may include tows obtained by bundling a plurality of the polyethylene terephthalate fiber obtained at a spinning speed of about 4000 m/min. or more, staple fibers obtained by cutting such tows at an appropriate length which are made run on a suitable conveyor such as a belt conveyor through a device or apparatus for heat treatment and such staple fibers in the form of a web or a sliver after opening or in the form of a spun yarn after spinning.

When the heat treatment of this invention is conducted in a wet heat atmosphere, a preferred temperature for heat treatment is $(T_{min}+10)$°C. to about 240° C. The heat treatment in a wet heat atmosphere according to this invention means a heat treatment by superheated steam.

When the heat treatment in a wet heat atmosphere according to this invention is conducted at a temperature lower than $(T_{min}+10)$°C., the polyethylene terephthalate fiber spun at a spinning speed of at least 4000 m/min. cannot be rendered easily dyeable under normal pressure but tends to be dyed in light shade. Also, when the heat treat in a wet heat atmosphere is conducted at a temperature higher than about 240° C., melting of the fibers occurs sometimes and the $E'_{220}$ remarkably decreases and as a result, the mechanical properties at high temperature often deteriorates. Even when the polyethylene terephthalate fiber produced by conventional spinning and drawing steps are subjected to the heat treatment in a wet heat atmosphere at a temperature ranging from $(T_{min}+10)$°C. to about 240° C., the fiber cannot be rendered easily dyeable under normal pressure. In contrast, when the undrawn polyethylene terephthalate fiber obtained at a spinning speed of at least about 4000 m/min. are subjected to the heat treatment in a wet atmosphere at a temperature within the above describe range, the fiber can be rendered easily dyeable under normal pressure and at the same time the elongation of the fiber tends to decrease without reduction in the tenacity, and accordingly the fiber changes into the one having a suitable elongation, i.e., about 10% to about 60% for use in forming clothing and a shrinkage in boiling water of about 5% or less.

For superheated steam which can be employed in this invention includes a mixture of air and steam, and the superheated steam can be represented by the mol ratio of air to steam: $(1-x)/x$ wherein x is a mol fraction of steam and at least about 0.3.

The temperature for the wet heat treatment which can be employed is about $(T_{min}+60-85x)$°C. to about $(290-50x)$°C. With increased spinning speeds a more preferred temperature for the wet heat treatment shifts to a higher region within the above described range. For example, in the wet heat treatment of a fiber obtained at a spinning speed of about 6000 m/min. to about 8000 m/min. the temperature employed is preferably about 225° C. to about 240° C.

In order to improve uneven dyeing of the fiber it is necessary that the temperature for the wet heat treatment is strictly controlled, and it is preferred that the temperature is controlled within a predetermined temperature ±0.5° C.

The dyeability of a polyethylene terephthalate fiber obtained at a spinning speed of at least 4000 m/min. by the wet heat treatment can be more improved when a higher temperature within the range of $(T_{min}+10)$°C. to about 240° C. is employed at the wet heat treatment and when the period of time for the wet heat treatment becomes longer. Accordingly, with higher temperatures for the wet heat treatment the period of time for the wet heat treatment becomes shorter. For example, the $T_{min}$ of a polyethylene terephthalate fiber obtained at a spinning speed of about 4500 m/min. is generally about 212° C. to about 213° C., and in order to render the fiber dyeable under normal pressure by the heat treatment in superheated steam at a temperature of $(T_{min}+10)$°C., i.e., about 222° C. to about 223° C., the period of time for the wet heat treatment is preferably about 0.1 to about 10 seconds, and by the heat treatment in superheated steam at a temperature of about 230° C. periods of time for the wet heat treatment of about 0.01 to about 0.8 second can provide the dyeability of the same degree and it is possible to employ a period of time for the wet heat treatment longer than about 0.8 second.

The device or apparatus for the wet heat treatment which can be employed in this invention may be any device or apparatus capable of providing a wet heat atmosphere at a temperature of $(T_{min}+10)$°C. to about 240° C. and its shape is not particularly limited. For example, the polyethylene terephthalate fiber obtained at a spinning speed of at least about 4000 m/min. may be passed through a cylinder into which superheated steam having a temperature within the above described range is jetted or through a cylinder whose external periphery is heated by an electric heater and into which superheated steam having a temperature within the above described range is jetted. On the polyethylene terephthalate fiber may be placed in an autoclave into which superheated steam or saturated steam is blown.

In the wet heat treatment according to this invention, when a polyethylene terephthalate fiber obtained at a spinning speed of at least 4000 m/min. is subjected to the wet heat treatment at an extension ratio of at least about −20% and less than about +5%, the mechanical properties of the fiber are superior to those of the fiber obtained without being set in the longitudinal direction of the fiber i.e., by keeping both ends of the fiber free during the wet heat treatment. When the fiber is subjected to the wet heat treatment keeping both ends of the fiber free, the tenacity of the fiber is almost the same as that before the wet heat treatment. On the other hand, when the fiber is subjected to the wet heat treatment at an extension ratio of at least about −20% and less than about +5%, the tenacity of the fiber becomes greater than that before the heat treatment. However, when the wet heat treatment is conducted at an extension ratio more than about +5%, the improvement on dyeability is small and as a result, the fiber cannot be rendered dyeable under normal pressure.

When the polyethylene terephthalate fiber obtained at a spinning speed of at least about 4000 m/min. is subjected to the wet heat treatment at a temperature of $(T_{min}+10)$°C. to about 240° C. keeping both ends of the fiber free, the shrinkage becomes about 25% or more. In other words, even at an extensibility of about −20% the fiber heat-treated is under strain and substantially in an elongated state. It is preferred that the extension ratio at the wet heat treatment is about −5% to about 0%. With greater mol fractions of steam x in superheated steam for the wet heat treatment, not only the treating temperature can be lowered but also uniformity in dyeing the treated fiber can be improved.

Figure 3:
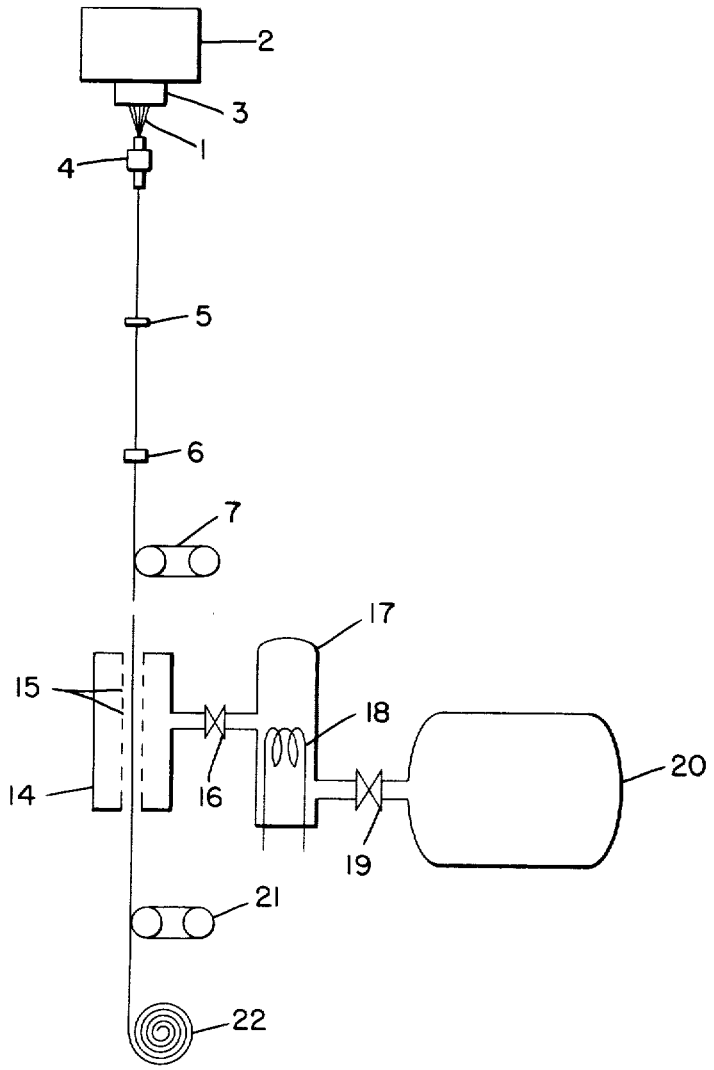
FIG. 3 is a diagram illustrating a further embodiment of an apparatus employed in the process of the present invention, in which the numbered elements 1 to 6 are the same as in FIG. 1 and other numbered elements are as follows: 7, a pair of take-up rollers; 14, a heating cylinder for wet heat treatment; 15, a plurality of slits from which superheated steam is jetted into the inside of the heating cylinder; 16, a valve; 17, a device for heating steam to give superheated steam; 18, a heater; 19, a valve; 20, a boiler; 21, a pair of delivery rollers; and 22, a winder.

FIG. 3 is a diagram illustrating a further embodiment of an apparatus employed in the process of the present invention, in which a melt of polyethylene terephthalate is extruded from a nozzle (not illustrated) mounted in a spinhead 2 heated at a predetermined temperature, and is cooled in the atmosphere to form filaments 1. In this apparatus a heating zone 3, for example, a heating cylinder surrounding the extruded filaments 1 is provided on the surface of the nozzle, and an aspirator 4 is provided below the heating zone 3 to suck and cool the filaments 1. The filaments passed through the heating zone 3 and the aspirator 4 are treated by a device 5 for providing an oiling agent with the filaments and a device 6 for bundling the filaments, and then are wound on a pair of take-up rollers 7 one to several times to take up the filaments. The rotation of the pair of take-up rollers 7 is controlled in such a manner that the speed of the filaments 1 is at least about 4000 m/min. Then the filaments are subjected to the heat treatment by superheated steam by passing through a heating cylinder 14 for heat treatment having a plurality of slits 15 from which superheated steam is jetted into the inside of the heating cylinder, and subsequently are wound on a pair of delivery rollers 21 one to several times while the tension of the fiber is controlled in order not to contact the fiber with the internal wall of the heating cylinder 14, and finally wound on a winder 22. On the other hand, saturated steam having a pressure of about 10 kg/cm$^2$ produced in a boiler 20 is introduced into a device 17 for heating steam through a valve 19 and is heated by a heater 18 to form superheated steam having a temperature of $(T_{min}+10)$°C. to about 240° C. This superheated steam is fed into a heating cylinder 14 for wet heat treatment while controlling the amount of superheated steam fed by a valve 16 and jetted through the plurality of slits 15 provided with the internal wall of the heating cylinder 14. Thus the wet heat treatment is continuously carried out following the spinning step. Also after the filaments 1 are wound on the winder 22 without being passed through the heating cylinder 14 for wet heat treatment, the filaments are subjected to wet heat treatment by a separatedly provided device or apparatus for wet heat treatment.

Figure 4:
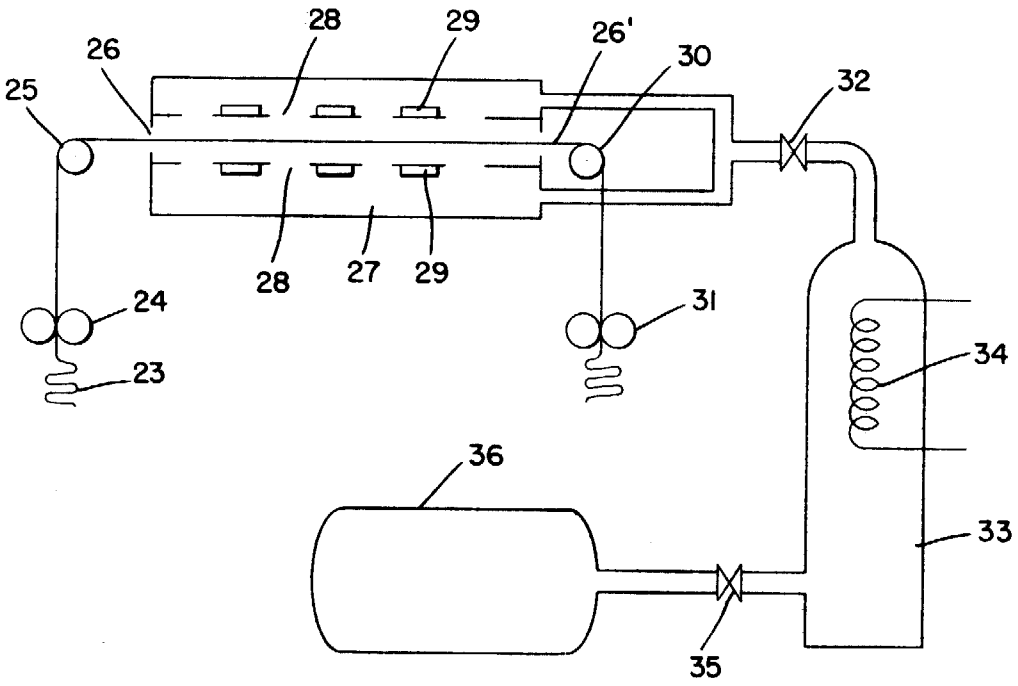
FIG. 4 is a diagram illustrating one embodiment of an apparatus for the wet heat treatment of a fiber bundle, a sliver or a tow using superheated steam employed in the present invention, in which the numbered elements are as follows: 23, a fiber bundle, a sliver or a tow; 24, a pair of feed rollers; 25, a guide roller; 26 and 26', slits for preventing excess leakage of superheated steam within a device for wet heat treatment 27 and controlling the fluctuation of temperature therein; 27, a device for wet heat treatment; 28, slits for jetting superheated steam provided with the internal wall of the device for wet heat treatment 27; 29, heaters for preventing lowering of the temperature of superheated steam within the device for wet heat treatment and reducing the distribution of temperature therein; 30, a guide roller; 31, a pair of delivery rollers for the fiber bundle, sliver or tow; 32, a valve; 33, a device for heating steam to give superheated steam; 34, a heater; 35, a valve; and 36, a boiler.

FIG. 4 is a diagram illustrating one embodiment of an apparatus for the wet heat treatment of a bundle of the polyethylene terephthalate fibers obtained at a spinning speed of at least about 4000 m/min. and not having undergone any subsequent wet heat treatment, such as a tow and a sliver, in which a fiber bundle 23 is drawn up by a pair of feed rollers 24 and reaches a guide roller 25 which guides the fiber bundle into a device 27 for wet heat treatment. At the inlet and the outlet of the device 27 for wet heat treatment are provided slits 26 and 26', respectively which prevents the change in the internal temperature of the device 27 for wet heat treatment by the external atmosphere. In the device 27 for wet heat treatment a number of slits 28 are provided on the internal wall of a passage of the fiber bundle 23 and superheated steam is jetted simultaneously at the upper and under surfaces of the fiber bundle 23 through the slits 28. Also in the device 27 for wet heat treatment heaters 29 are provided to control the temperature of superheated steam. Saturated steam having a pressure of about 10 kg/cm$^2$ produced in a boiler 36 is fed into a device 33 for heating steam through a valve 35 and is heated by a heater 34 to form superheated steam having a temperature of $(T_{min}+10)$°C. to about 240° C. This superheated steam is fed into a device 27 for wet heat treatment through a valve 32 and are jetted at the fiber bundle 23 from the slits 28 while controlling the temperature distribution therein not to increase by heaters 29. The fiber bundle 23 having undergone the wet heat treatment is passed through the slit 26' to lead to a guide roller 30 and is taken up by a take-up roller 31.

Further, when the fiber is used in the field where the modulus and the tenacity of the fiber are required to be increased and the elongation is required to be reduced, the fiber after the heat treatment by dry heat or wet heat may be subjected to stretching. When such stretching is conducted at a stretching ratio of about 1.05 to about 2.0 at a temperature below about 110° C., the mechanical properties are improved and the dyeability does not change.

According to this invention a melt of a polymer consisting essentially of polyethylene terephthalate may be extruded at a spinning speed of at least about 4000 m/min. to form a fiber, once wound and subsequently subjected to the wet heat treatment or the wet heat treatment may be continuously conducted following the spinning step. Since the temperature of the fibers at the time of winding is preferably lower, it is preferred for practical purposes including the temperature of wet heat treatment and the amount of the fiber to be wet heat-treated that the wet heat treatment is discontinuously conducted after the spinning step.

Further the fibers which can be subjected to the wet heat treatment may include tows obtained by bundling a plurality of the polyethylene terephthalate fiber obtained at a spinning speed of about 4000 m/min. or more, staple fibers obtained by cutting such tows at an appropriate length which are made run on a suitable conveyor such a belt conveyor through a device or apparatus for wet heat treatment, such tows or staple fibers placed in cans having a number of holes which are charged in an autoclave for wet heat treatment and such staple fibers in the form of a web or a sliver after opening or in the form of a spun yarn after spinning.

Details will now be given of the false twist polyethylene terephthalate fiber of this invention.

As a result of a study on the relationship between the fine structure of an amorphous region of a false twist polyethylene terephthalate fiber, and the dyeability, it has been found that in order for the false twist polyethylene terephthalate fiber to have a dyeability under normal pressure, the fiber is also required to satisfy the above described conditions (II) and (III) as in the polyethylene terephthalate fiber not undergoing false twisting. False twist fibers of unmodified polyethylene terephalate which satisfy the above described conditions (II) and (III) are not known and conventional false twist polyethylene terephthalate fibers cannot be dyed under normal pressure and the $T_{max}$ and the $(\tan\delta)_{max}$ of such conventional false twist polyethylene terephthalate fibers are 130° C. or higher and 0.14 or less, respectively.

The fine structure of the false twist fiber is thermally stabilized at false twisting and accordingly, the behavior at dyeing of the false twist fiber is different from the fiber before false twisting. For example, when the $T_{max}$ of a fiber capable of being dyed under normal pressure before false twisting is about 105° C. or lower and the $(\tan\delta)_{max}$ is about 0.14 or more, the dyeability increases. Also when the $T_{max}$ is about 105° C. or lower, the dyeability increases with increased $(\tan\delta)_{max}$ values without any particular limitation to the $(\tan\delta)_{max}$ only from the viewpoint of dyeability. Also the false twist fiber can be remarkably rendered easily dyeable with greater $(\tan\delta)_{max}$ values or with low $T_{max}$ values. However, in order for the false twist fiber to be dyeable under normal pressure the false twist fiber is required to satisfy at least the above described condition (II). Generally when false twisting is conducted at a temperature of about 180° C. or higher, the false twist fiber nearly satisfies the above described condition (III). In order for the false twist fiber to satisfy the above described condition (II), for example, it is necessary that the fiber before false twisting is obtained by winding at a spinning speed of about 4000 m/min. or more and subsequently heat-treating the fiber once wound at a high temperature, typically at about 230° C. or higher for a short period of time, typically shorter than about two seconds by dry heat or heat-treating the fiber once wound by wet heat such as superheated steam at a temperature of $(T_{min}+10)$°C. to about 240° C. On the other hand, in conducting false twisting of an unstretched fiber obtained at a spinning speed less than about 4000 m/min. or a stretched fiber obtained by subsequently stretching such an unstretched fiber, it is usual to employ a heat setting temperature of about 150° C. to about 215° C. and a load of about 0.15 g/d Tex to about 0.5 g/d Tex in the twisting-heat setting-untwisting procedure in order to reduce in change of the dyeability before or after false twisting, to improve heat setting and to reduce in disappearance of crimping. The false twist fiber obtained under these conditions has a $T_{max}$ of about 135° C., a $(\tan\delta)_{max}$ of about 0.10 and nearly the same dyeability as the fiber before false twisting or a slightly improved dyeability compared with the fiber before false twisting, and accordingly cannot be said to be dyeable under normal pressure. In order to more improve the dyeability of the false twist fibers of this invention, the $T_{max}$ is about 115° C. or lower and at the same time the $(\tan\delta)_{max}$ is about 0.14 or more. In this case, however, growth of a crystalline region is essential to increase the thermal stability.

The false twist polyethylene terephthalate fiber of this invention is required to have an initial modulus at 30° C. of at least about 55 g/d in order to have the suitable inherent properties of polyester fibers. For this reason the $(\tan \delta)_{max}$ is required to be at most about 0.30.

It is preferred that the false twist polyethylene terephthalate fiber of this invention has a number of crimp of at least about 500/m. and a crimp stretchability of at least about 100%.

As with the polyethylene terephalate fiber not undergoing false twisting, the χc, ACS and CO are all closely related to the deformation of the false twist polyethylene terephalate fiber by the external influence and the thermal stability of the structure. In this invention it is preferred that the χc is about 70% to about 90%, the ACS is about 50 Å to about 85 Å and the CO is about 85% to about 97%, so that the false twist fiber of this invention has suitable properties as the polyester crimp fiber such a tenacity of at least about 3 g/d, an elongation of about 20% to about 60% and an initial modulus of about 55 g/d to about 130 g/d. On the other hand, the conventional false twist fiber has a χc of about 20% to about 30%, an ACS of about 30 Å and a CO of about 85%.

As a typical embodiment of a process for producing the false twist fiber of this invention, an undrawn polyethylene terephthalate fiber wound at a spinning speed of about 5000 m/min. is heat-treated in a tube heater whose surface temperature is 255° C. for 0.6 second at 0% extension without contacting the surface of the heater and subsequently is subjected to false twisting at 200° C. and at an over feed ratio of 5%.

It is preferred from the viewpoint of dyeability under normal pressure of the false twist fiber that the polyethylene terephalate fiber before false twisting in this invention is required to have a $(\tan \delta)_{max}$ of about 0.14 or more, a $T_{max}$ of about 115° C. or lower and an initial modulus at 30° C. of at least about 55 g/d. Also it is preferred that the false twist polyethylene terephthalate fiber has a smaller $\tan \delta_{220}$ due to the small decrease in the initial modulus accompanying an increase of temperature in the vicinity of 200° C. When the $\tan \delta_{220}$ is about 0.005 or less, the decrease in the initial modulus accompanying an increase of temperature is remarkably reduced, and the structure of the fiber becomes extremely stable to heat.

In the present invention, a fiber before false twisting having desirable properties can be prepared with good efficiency of spinning when cooling and solidification and dimensional transformation of a polyethylene terephthalate polymer extruded from a nozzle are controlled by regulating conditions such as polymer viscosity, spinning temperature, conditions of the atmosphere below the nozzle, the method for cooling extruded filaments and the speed of spinning. It is important to control the cooling and solidification of extruded filaments since sudden cooling and solidification of extruded filaments and cooling and solidification by use of cooling air having a low temperature in a single direction crossing at a right angle to the filaments, are not preferred to achieve good efficiency of spinning and desirable properties. Also the above described fiber before false twisting in this invention can be employed as the fiber for false twisting.

Figure 5:
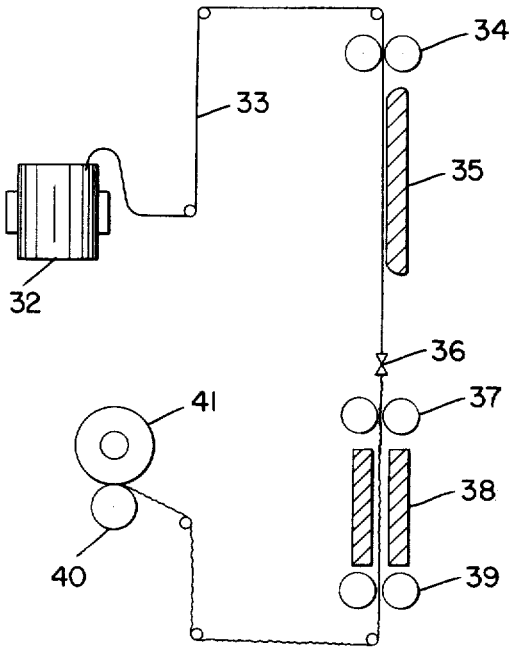
FIG. 5 is one embodiment of a false twisting apparatus employed in the production of the false twist fiber of this invention, in which the numbered elements are as follows: 33, a package of fiber; 33, a fiber; 34, a first pair of feed rollers; 35, a first heater; 36, a spindle; 37, a pair of feed rollers; 38, a second heater i.e., a stabilizing heater; 39, a pair of delivery rollers; 40, a friction roller; and 41, a bobbin for winding.

The fiber before false twisting is subjected to false twisting by a conventional false twisting apparatus as shown in FIG. 5. The false twist fiber of this invention has a good dyeability at atmospheric pressure at 100°C., and the structural transformation against heat given in the procedure of preparing a final product is small due to the particular fine structure and is especially useful as the fiber in forming clothing.

The polyethylene terephthalate fiber of this invention includes monofilaments, flat yarns and false twist yarns of monofilaments and multifilaments, tows, staple fibers or cut fibers having an appropriately cut length and crimps as the starting material for spinning, webs obtained by opening the staple fibers, slivers made from the webs and spun yarns made from the slivers. Since the polyethylene terephalate fiber of this invention has the fine structure as defined in this invention, the fiber can be dyed by a disperse dye under normal pressure and accordingly can be dyed without using a carrier by a normal pressure dyeing machine. For this reason, it is possible to dye not only products solely made of the polyethylene terephthalate fibers but also products made of the polyethylene terephthalate fibers in admixture with acrylic fibers, wool or spandex fibers without rendering the acrylic fibers, wool or spandex fibers brittle, which has been considered difficult. Further there can be obtained dyed products made of the polyethylene terephthalate fibers in admixture with regenerated cellulose fibers and having excellent mechanical properties. Also in printing, steaming under normal pressure is possible with products made of the polyethylene terephthalate fibers or its admixture with acrylic fibers, wool, spandex fibers or regenerated cellulose fibers and thus reduction in cost is favorably brought about and there can be obtained printed products thereof having excellent hand touchness and mechanical properties.

Methods for Measuring Parameters to Be Used for Specifying the Structural Properties of the Present Invention

A. Dynamic Mechanical Loss Tangent (tan δ) and the Dynamic Modulus (E')

The dynamic mechanical loss tangent (tan δ) and the dynamic modulus (E') can be measured by using an apparatus for direct reading dynamic viscoelasticity manufactured by Toyo Baldwin, Rheo-Vibron DDV-IIc, at a frequency of 110 Hz, in dry air and at a temperature increasing at a rate of 10° C./min.

A peak temperature ($T_{max}$) of tan δ and a peak value $[(\tan \delta)_{max}]$ of tan δ are obtained from the tan δ-temperature curve. Typical embodiments of a tan δ-temperature curve and an E' -temperature curve are illustrated in FIGS. 11(*a*) and 11(*b*), wherein (A) represents a fiber of the present invention, (B) represents a conventional stretched fiber, (C) represents an unstretched fiber and (D) represents a partially oriented fiber.

B. Apparent Crystal Size (ACS)

ACS can be determined by measuring the X-ray diffraction intensity in the equatorial direction by the reflection method. The measurement is carried out by using an X-ray generator (RU-200PL manufactured by Rigaku Denki), a goniometer (SG-9R manufactured by Rigaku Denki), a scintillation counter and a pulse height analyzer. Cu-$K_\alpha$ (wavelength $\lambda = 1.5418$ Å) monochromatized by a nickel filter is used for the measurement. The fiber sample is set in a sample holder composed of aluminum so that the fiber axis is perpendicular to the plane of the diffraction. The thickness of the sample is adjusted to about 0.5 mm.

The X-ray generator is operated at 30 kV and 80 mA. The diffraction intensity is recorded from 7° to 35° of 2θ at a scanning speed of 1°/min., a chart speed of 10 mm/min., a time constant of 1 second, a divergent slit of ½°, a receiving slit of 0.3 mm, and a scattering slit of ½°. The full scale deflection of the recorder is set so that the entire diffraction curve remains on the scale.

Figure 12:
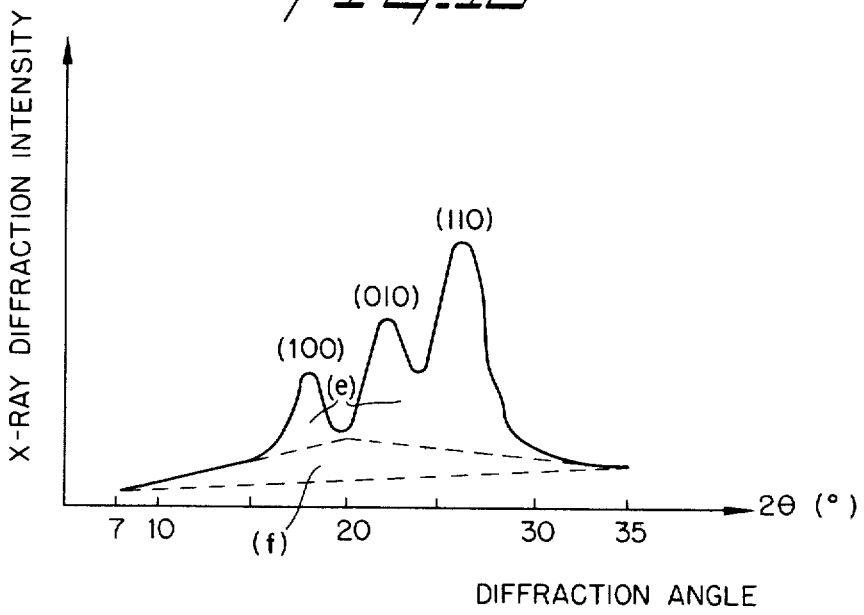
FIG. 12 is a graph of one embodiment illustrating a curve of X-ray diffraction intensity of polyethylene terephthalate fiber, in which (e) represents a portion of the X-ray diffraction intensity attributed to the crystalline region and (f) represents a portion of the X-ray diffraction intensity attributed to the amorphous region.

Generally, a polyethylene terephthalate fiber has three major reflections on the equatorial line in the range of from 17° to 26° of 2θ (at faces of (100), (010), and (110)). FIG. 12 is a graph of one embodiment illustrating a curve of X-ray diffraction intensity of a polyethylene terephthalate fiber, in which (e) is a portion the X-ray diffraction intensity attributed to the crystalline region and (f) is a portion of the X-ray diffraction intensity attributed to the amorphous region.

For example, ACS is determined according to the equation of Scherrer described in L.E. Alexander, X-ray Diffraction Methods in Polymer Science, Chapter 7, published by John Wiley & Sons, Inc., New York.

A base line is established by drawing a straight line between 7° and 35° of 2θ on the diffraction intensity curve. A vertical straight line is dropped from the diffraction peak, and the mid-point between the peak and the base line is marked. A horizontal line passing through the mid-point is drawn on the diffraction intensity curve. If the two major reflections are sufficiently separated from each other, this line intersects shoulders of the two peaks of the diffraction intensity curve, but if they are not sufficiently separated, the line intersects one shoulder alone. The width of the peak (half value width) is measured. If the line intersects one shoulder alone, the distance between the intersecting point and the mid-point is measured and doubled. If the line intersects two shoulders, the distance between the two shoulders is measured. The measured value is converted to a line breadth in radians and the line breadth is corrected according to the formula:

$$\beta = \sqrt{B^2 - b^2}$$

wherein B is the observed line breadth, and b is the broadening constant in radians, which is determined by the half value width of the reflection peak of a silicon single crystal at the face (111) thereof.

The apparent crystal size is given by the formula:

$$\text{ACS (Å)} = K \cdot \lambda / \beta \cos\theta$$

wherein K is taken as one, λ is the X-ray wavelength (1.5418 Å), β is the corrected line breadth and θ is the Bragg angle (half of 2θ).

C. Degree of Crystallinity (χc)

A base line is established by drawing a straight line between 7° and 35° of 2θ on the diffraction intensity curve, which is derived by the same method used to measure ACS. As shown in FIG. 12, the crystalline portion and the amorphous portion are separated by drawing a straight line along the tail of the lower angle and the tail of the higher angle from the peak point positioned near the angle of 20° of 2θ. The χc is represented by an area analysis method according to the following equation:

$$\chi c = \frac{\text{Scattering intensity of crystalline portion}}{\text{Total scattering intensity}} \times 100$$

D. Degree of Crystal Orientation (CO)

The degree of crystal orientation is measured by using an X-ray generator (for example, RU-200PL manufactured by Rigaku Denki), a fiber measuring device (FS-3 manufactured by Rigaku Denki), a goniometer (SG-9 manufactured by Rigaku Denki), a scintillation counter and a pulse height analyzer.

Cu-Kα (wavelength λ=1.5418 Å) monochromatized by a nickel filter is used for the measurement. Generally, although a polyethylene terephthalate fiber has three major reflections on the equatorial line, the reflection at the (010) face is used in the measurement of the CO. The 2θ value of the reflection of the (010) face used is determined from the curve of the diffraction intensity in the equatorial direction.

The X-ray generator is operated at 30 kV and 80 mA. The fiber sample is attached to the fiber measuring device so that filaments are parallel to one another.

Preferably the sample thickness is about 0.5 mm. The goniometer is set at the 2θ value determined by the diffraction intensity curve in the equatorial direction. Scanning is conducted in the range of from −30° to +30° in the azimuthal direction according to a method of transmission, and the diffraction intensity in the azimuthal direction is recorded by the scintillation counter. Furthermore, the diffraction intensity at −180° in the azimuthal direction and the diffraction intensity at +180° in the azimuthal direction are recorded. At this measurement, the scanning speed is 4°/min., the chart speed is 10 mm/min., the time constant is 1 second, the collimeter is characterized by 2 mmϕ and the receiving slit has a length of 19 mm and a width of 3.5 mm.

The CO value is determined from the obtained diffraction intensity curve in the azimuthal direction according to the following procedures. A mean value of the diffraction intensity value obtained at ±180° is evaluated, and a horizontal line (a base line) is drawn to pass through the point of the mean value. A perpendicular line is drawn to the base line from the peak, and the mid-point of the perpendicular line is determined and a horizontal line passing through the mid-point is drawn. The distance between two intersecting points of the horizontal line and the diffraction intensity curve is measured and the measured value is converted to an orientation angle H(°) in degrees (°). The degree of crystal orientation (CO) is represented by the equation:

$$CO\,(\%) = \frac{180° - H}{180°} \times 100$$

E. Mean Refractive Index ($n_{\parallel}$, $n_{\perp}$) and Mean Birefringence Index (Δn)

According to the interference fringe method using a transmission quantitative type interference microscope (for example, an interference microscope "Interphako" manufactured by Carl-Zeiss Yena Co., East Germany), the distribution of the mean refractive index, observed from the side face of the fiber, can be determined. This method can be applied to fibers having a circular cross section.

The refractive index of fibers is characterized by a refractive index to polarized light having an electric field vector in the direction parallel to the fiber axis ($n_{\parallel}$) and a refractive index to polarized light having an electric field vector in the direction perpendicular to the fiber axis ($n_{\perp}$).

Refractive indices ($n_{\parallel}$ and $n_{\perp}$) obtained by using green radiation (wavelength λ=549 mμ) are employed.

The fiber to be tested is immersed in a medium inert to fibers having a refractive index (N) giving a deviation of the interference fringe in the range of 0.2 to 2.0 times the wavelength by using optical flat slide glass and cover glass.

The refractive index (N) of the medium is a value measured at 20° C. by an Abbe refractometer using green radiation (wavelength $\lambda = 549$ m$\mu$).

Several filaments are immersed in the medium so that the filaments are not in contact with one another. The fiber should be disposed so that the fiber axis is perpendicular to the optical axis of the interference microscope and the interference fringe. The pattern of the interference fringe is photographed and enlarged at about 1,500 magnifications for analysis.

Figure 13:
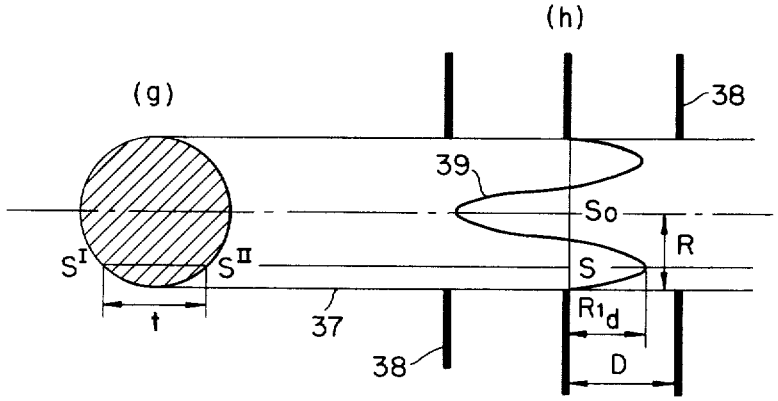
FIG. 13 is one embodiment of a pattern of interference fringe that was used to measure a distribution of a refractive index ($n_{\parallel}$ or $n_{\perp}$) in the direction of a radius of the cross section of a fiber, in which (g) is a cross section of a fiber and (h) is a pattern of an interference fringe in which the numbered elements are as follows: 37, a fiber; 38, an interference fringe by a medium; and 39, an interference fringe by a fiber.

Referring to FIG. 13, the optical path difference $\Gamma$ is represented by the formula:

$$\Gamma = \frac{d}{D}\lambda = [n_{\parallel}(\text{or } n_{\perp}) - N]t$$

wherein N is the refractive index of the medium, $n_{\parallel}$ (or $n_{\perp}$) is the refractive index between $S^I$–$S^{II}$ at the periphery of the fiber, t is the thickness between $S^I$–$S^{II}$, $\lambda$ is the wavelength of the radiation used, D is the distance (corresponding to $1\lambda$) between parallel interference fringes of the background and d is the deviation of the interference fringe by the fiber.

From optical path differences at respective positions in the range of the center of the fiber ($R_o$) to the periphery of the fiber (R), the distribution of the refractive index $n_{\parallel}$ (or $n_{\perp}$) of the fiber at the respective positions can be determined. When r is the distance from the center of the fiber to the respective position, the refractive index at the center of the fiber, i.e., $X = r/R = 0$ is defined as the mean refractive index [$n_{\parallel(0)}$ or $n_{\perp(0)}$]. X is 1 at the position of the periphery of the fiber, but X is a value of 0 to 1 at the other position of the fiber.

For example, $n_{\parallel(0.8)}$ (or $n_{\perp(0.8)}$) represents the refractive index at the position of $X = 0.8$. From the mean refractive indices $n_{\parallel(0)}$ and $n_{\perp(0)}$, the mean birefringence index ($\Delta n$) is represented as $\Delta n = n_{\perp(0)} - n_{\perp(0)}$. In FIG. 13, 37 is the fiber; 38 is the interference fringe by the medium; and 39 is the interference fringe by the fiber. $\Delta n_{(0.8-0)}$ means a difference in $\Delta n$ between $X = 0$ and $X = 0.8$. With a fiber having a modified cross section the refractive index determined by the Becke line method is defined as $X = 0.8$ and further the refractive index of the medium at $\Gamma = 0$, i.e., $d = 0$, observed by an interference microscope, is defined as a refractive index at $X = 0$.

F. Shrinkage in Boiling Water

Shrinkage in boiling water is represented by the equation:

$$\text{Shrinkage in boiling water (\%)} = \frac{L_o - L}{L} \times 100$$

wherein $L_o$ is the length of a sample under the load of 0.1 g/d, and L is the length of the sample under the initial load of 0.1 g/d after the treatment in boiling water without the load for 30 minutes.

G. Melting Completion Temperature ($T_{m3}$)

Figure 14:
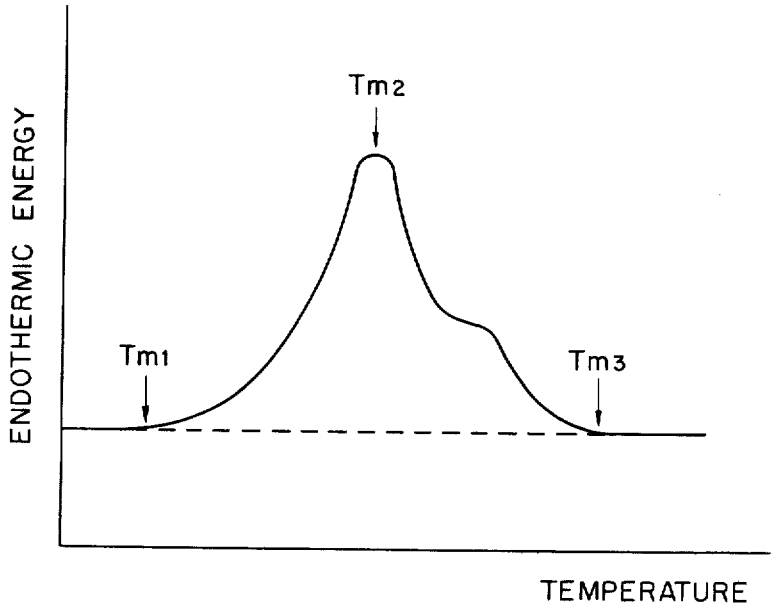
FIG. 14 is a diagram illustrating a temperature of completion of melting ($T_{m3}$) by a differential scanning calorimeter.

A melting curve is measured by heating about 1.5 mg of a sample in a $N_2$ gas atmosphere from a temperature of about 180° C. at a rate of increasing the temperature of 20° C./min. using a differential scanning calorimeter (DSC-1b manufactured by Perkin-Elmer). The $T_{m3}$ is defined as a temperature of completion of melting at the melting curve as indicated in FIG. 14. The $T_{m2}$ is a peak temperature and the $T_{m1}$ is a temperature of initiation of melting.

H. Dyeability

The dyeability is evaluated by a degree of dye exhaustion. A sample is dyed with a disperse dye (Resolin Blue FBL, C.I. Disperse 56, Tradename of Bayer in Federal Republic of Germany) at a dye concentration of 3% owf and a liquor ratio of 1 to 50 at 100° C. Further a dispersing agent (Disper TL) of 1 g/l is added to the dyeing solution, and then acetic acid is added to condition the pH of the solution to 6.

After a predetermined period of time of dyeing (one hour), part of the dyeing solution is collected and the amount of dye remaining in the dyeing solution is measured by absorbance at 625 mm. Then the amount of dye exhausted is obtained by subtracting the remaining amount of dye from the amount of dye employed in dyeing. The dye exhaustion ratio is calculated by dividing this exhausted amount of dye by the amount of dye employed and multiplying the result by 100.

The sample which is scoured with Scourol FC-250 (tradename of Kao-Atlas) of 2 g/l at 60° C. for 20 minutes, dried, and conditioned at a relative humidity of 65% at 20° C. for 24 hours is employed.

Whether a fiber can be dyed under normal pressure or not is determined by comparing the dye exhaustion of the fiber with that of a conventional polyethylene terephthalate fiber which is dyed at 130° C. for 60 minutes under the above described conditions, i.e., 80%. If the dye exhaustion of a fiber is 80% or more, the fiber can be judged to have a good dyeability under normal pressure.

I. Color Fastness of Dyed Fibers

The sample is dyed by the same method as in the evaluation of dyeability described above except that the concentration of dye is 1% owf and dyeing time is 90 minutes. Further, the sample is carried out reduction cleaning with sodium hydrosulfate of 1 g/l and sodium hydroxide of 1 g/l, and a surface active agent (Sunmol RC-700) of 1 g/l at a liquor ratio of 1 to 50 at 80° C. for 20 minutes.

The samples are evaluated according to JIS-L-1044 for color fastness to light, JIS-L-0489 for color fastness to rubbing and JIS-L-0854 for color fastness to sublimation. The judgement of these evaluations is given by 5 grades, from 1 for the lowest to 5 for the highest and determined by examination with the naked eye.

J. Initial Modulus

Initial Modulus is the value of the dynamic modulus (E') at 30° C. obtained by measuring the dynamic modulus as described above.

K. Tenacity and Elongation

Tenacity and elongation are measured using a tensile testing machine, Tensilon UTM-II-20 manufactured by Toyo Baldwin, at an initial length of 5 cm and a tensile velocity of 20 mm/min. with a fiber having a crimp, the initial length of 5 cm employed is the length of the crimp elongated.

L. Crimp Retention

Of the rate of crimp appearance described in Japanese Patent Application (OPI) No. 35112/1973, the $CD_{5.0}$ is employed. First, the $CD_{5.0}$ of a textured yarn obtained by the stretching-false twisting procedure is designated as $\alpha$. Second, the textured yarn under a load of 0.1 g/d is immersed in boiling water at 100° C. for one minute and subsequently is spontaneously dried at 20° C. at a relative humidity of 60% in keeping both ends of the yarn free and left to stand at 20° C. at a relative humidity of 60% for 24 hours. Then the $CD_{5.0}$ of the textured yarn thus treated is measured again and designated as $\beta$. The crimp retention is represented by the equation:

$$\text{Crimp retention } (\%) = \beta/\alpha \times 100$$

Usually the crimp retention of 65% or more is judged to be good.

The present invention will now be illustrated in detail by the following examples.

Example 1

Polyethylene terephthalate having an intrinsic viscosity [η] of 0.63 dl/g, which was measured in a mixed solvent of a 2:1 volume ratio of phenol and tetrachloroethane at 35° C., was extruded from a nozzle having 7 fine holes 0.35 mm in diameter at a spinning temperature of 300° C. The filaments extruded were cooled and solidified with a stream of air at 22° C. supplied from the direction of all the circumference of the fiber in the parallel direction of the running filaments and then, after adding an oiling agent, the filaments were wound at a spinning speed of 3000 m/min. to 7000 m/min. to give multifilaments of 35d/7f. Subsequently the wound multi-filaments were subjected to heat treatment by passing through a heater for heat treatment 9 as shown in FIG. 1 whose internal temperature was adjusted at 240°±0.5° C. for one second at 1.5% extension without any contact with the surface of the heater.

The features of the fine structure and mechanical properties of the polyethylene terephthalate fiber thus obtained are shown in Table 1. The fibers of Run Nos. 1 to 4 belong to this invention and those of Run Nos. 5 to 7 are outside this invention. It can be understood that the fibers of this invention prepared in Run Nos. 1 to 4 have adequate mechanical properties, thermal stability, dyeability under normal pressure and color fastness. On the other hand, the fibers outside this invention prepared in Run Nos. 5 to 7 are not sufficient in all these properties.

TABLE 1

| Run No. | Spinning Speed (m/min.) | Draw Ratio*1 | Dynamic Viscoelastic Properties: $T_{max}$ (°C.) | $(\tan\delta)_{max}$ (−) | $\tan\delta_{220}$ (−) | $E'_{30}$ (g/d) | Refractive Index: Δn (×10⁻³) | $n_{\parallel(0)}$ (−) | $\Delta n_{\parallel(0.8-0)}$ (×10⁻³) | Distribution of Local Refractive Index |
|---|---|---|---|---|---|---|---|---|---|---|
| 1 | 7000 | — | 94 | 0.150 | 0.024 | 73 | 120 | 1.692 | 15 | symmetry |
| 2 | 6000 | — | 95 | 0.170 | 0.030 | 70 | 117 | 1.684 | 9 | " |
| 3 | 5000 | — | 96 | 0.200 | 0.045 | 69 | 91 | 1.666 | 7 | " |
| 4 | 4000 | — | 98 | 0.210 | 0.050 | 67 | 59 | 1.649 | 5 | " |
| 5*2 | 3000 | — | 95 | 0.320 | 0.060 | 35 | 30 | 1.592 | 4 | " |
| 6*2 | 1500 | 3.3 | 135 | 0.105 | 0.035 | 97 | 173 | 1.691 | 2 | " |
| 7*2 | 1000 | 4.0 | 137 | 0.100 | 0.037 | 102 | 182 | 1.693 | 2 | unsymmetry |

| Run No. | Crystal Structure: χc (%) | ACS (Å) | CO (%) | Mechanical & Thermal Properties: Tenacity (g/d) | Elongation (%) | Shrinkage in Boiling water (%) | $E'_{220}/E'_{150}$ | Degree of Dye Exhaustion (%) | Color Fastness: Light | Rubbing | Sublimation |
|---|---|---|---|---|---|---|---|---|---|---|---|
| 1 | 76 | 55 | 95 | 4.3 | 38 | 2.9 | 0.75 | 94 | 4~5 | 5 | 4 |
| 2 | 70 | 51 | 92 | 4.1 | 47 | 2.9 | 0.72 | 93 | 4~5 | 4~5 | 3~4 |
| 3 | 52 | 48 | 87 | 3.6 | 56 | 3.1 | 0.70 | 93 | 4~5 | 4~5 | 3 |
| 4 | 31 | 40 | 85 | 2.7 | 61 | 3.5 | 0.69 | 90 | 4~5 | 5 | 3 |
| 5* | 26 | 23 | 51 | 2.1 | 82 | 32.0 | 0.65 | 80 | 4~5 | 5 | 3 |
| 6* | 62 | 18 | 90 | 5.0 | 23 | 7.8 | 0.55 | 45 | 3 | 4~5 | 3 |
| 7* | 56 | 20 | 91 | 5.1 | 21 | 8.2 | 0.56 | 51 | 3 | 4~5 | 3 |

*1Draw ratio at 160° C.

*2Fibers of Run Nos. 5 to 7 are outside the scope of this invention.

Example 2

Polyethylene terephthalate having a [η] of 0.63 dl/g was extruded from a nozzle having 7 fine holes 0.35 mm in diameter at a spinning temperature of 300° C. The filaments extruded were cooled and solidified with a stream of air at 22° C. supplied from the direction of all the circumference of the fiber in the parallel direction of the running filaments and then, after adding an oiling agent, the filaments were wound at a spinning speed of 4000 m/min. to 9000 m/min. to give multifilaments of 35d/7f. Subsequently the multifilaments thus obtained were subjected to heat treatment by passing through a heater for heat treatment 9 as shown in FIG. 1 whose internal temperature was adjusted at 245° C. for 0.8 second at 2% extensibility without any contract with the surface of the heater.

The features of the fine structure and mechanical properties of the polyethylene terephthalate fiber thus obtained are shown in Table 2.

As a reference, the fiber of 35d/7f having been spun at a spinning speed of 3000 m/min. and the fiber of 35d/7f having been spun at a spinning speed of 1500 m/min. and then drawn at 130° C. at a draw ratio of 3.3 were subjected to the same heat treatment as described above. The properties of these fibers are also shown in Table 2.

From Table 2 it can be understood that the fibers having been obtained at a spinning speed of 4000 m/min. or more and then heat-treated at 245° C. for 0.8 second at 2% extension are rendered easily dyeable and are excellent in color fastness and fully satisfactory in mechanical properties and thermal stability. In contrast, the fiber having been obtained at a spinning speed of 3000 m/min. and then heat-treated under the above described conditions is rendered easily dyeable but is poor in mechanical properties, and the fiber having been obtained at a spinning speed of 1500 m/min., drawn and then heat-treated under the above described conditions is not rendered easily dyeable.

TABLE 2

| Run No. | Spinning Speed (m/min.) | Draw Ratio*1 | Dynamic Viscoelastic Properties $T_{max}$ (°C.) | $(\tan\delta)_{max}$ (–) | $\tan\delta_{220}$ (–) | $E'_{30}$ (g/d) | Refractive Index $\Delta n$ ($\times 10^{-3}$) | $n_{\parallel}(0)$ (–) | Distribution of Local Refractive Index | $T_{min}$*3 (°C.) | $T_{m2}/T_{m3}$*3 (°C./°C.) |
|---|---|---|---|---|---|---|---|---|---|---|---|
| 1 | 9000 | — | 98 | 0.141 | 0.018 | 76 | 119 | 1.696 | symmetry | 230 | 269/297 |
| 2 | 8000 | — | 97 | 0.145 | 0.020 | 77 | 120 | 1.696 | " | 224 | 268/296 |
| 3 | 7000 | — | 93 | 0.152 | 0.023 | 79 | 121 | 1.695 | " | 219 | 263/294 |
| 4 | 6000 | — | 94 | 0.173 | 0.033 | 80 | 119 | 1.690 | " | 215 | 254/287 |
| 5 | 5000 | — | 96 | 0.204 | 0.047 | 80 | 96 | 1.681 | " | 213 | 258/282 |
| 6 | 4000 | — | 99 | 0.211 | 0.052 | 57 | 65 | 1.653 | " | 212 | 256/284 |
| 7*2 | 3000 | — | 91 | 0.322 | 0.059 | 38 | 31 | 1.594 | " | 202 | 257/287 |
| 8*2 | 1500 | 3.3 | 134 | 0.106 | 0.037 | 95 | 176 | 1.692 | unsymmetry | 208 | 262/291 |

| Run No. | Crystal Structure $\chi_c$ (%) | ACS (Å) | CO (%) | Mechanical & Thermal Properties Tenacity (g/d) | Elongation (%) | Shrinkage in Boiling water (%) | $E'_{220}/E'_{150}$ | Degree of Dye Exhaustion (%) | Color Fastness Light | Rubbing | Sublimation |
|---|---|---|---|---|---|---|---|---|---|---|---|
| 1 | 80 | 75 | 94 | 3.5 | 26 | 1.5 | 0.81 | 95 | 4~5 | 5 | 4~5 |
| 2 | 78 | 65 | 94 | 3.8 | 29 | 1.7 | 0.79 | 95 | 4~5 | 5 | 4~5 |
| 3 | 76 | 58 | 93 | 4.4 | 37 | 2.8 | 0.75 | 94 | 4~5 | 5 | 4 |
| 4 | 68 | 54 | 91 | 4.2 | 44 | 3.2 | 0.73 | 94 | 4~5 | 4~5 | 3~4 |
| 5 | 52 | 51 | 86 | 3.6 | 59 | 3.3 | 0.72 | 93 | 4~5 | 4~5 | 3 |
| 6 | 32 | 43 | 83 | 3.5 | 63 | 4.4 | 0.70 | 91 | 4~5 | 5 | 3 |
| 7*2 | 28 | 25 | 49 | 2.3 | 85 | 31.0 | 0.66 | 81 | 4~5 | 5 | 3 |
| 8*2 | 60 | 19 | 88 | 5.1 | 24 | 7.7 | 0.57 | 43 | 3 | 4~5 | 3 |

*1Draw ratio at 130° C.
*2Fibers of Run Nos. 7 and 8 are outside the scope of this invention.
*3$T_{min}$ and $T_{m3}$ are values before the heat treatment.

Example 3

Polyethylene terephthalate having a [η] of 0.64 was extruded from a nozzle having 7 fine holes 0.35 mm in diameter at a spinning temperature of 300° C.. The filaments extruded were cooled and solidified with a stream of air at 22° C. supplied from the direction of all the circumference of the fiber in the parallel direction of the running filaments and then, after adding an oiling agent, the filaments were wound at a winding speed of 4000 m/min. to 9000 m/min. to give multifilaments of 35d/7f. Subsequently the multifilaments thus obtained were subjected to heat treatment by passing through a heater for heat treatment 9 as shown in FIG. 1 whose internal surface temperature was adjusted at 240° C. for 0.7 second at a speed of 60 m/min. at 2% extensibility without any contact with the surface of the heater.

The features of the fine structure and properties of the polyethylene terephthalate fiber thus obtained are shown in Table 3.

As a reference, the fiber of 35d/7f having been obtained at a spinning speed of 3000 m/min. and the fiber of 35d/7f having been spun at a winding speed of 1500 m/min. and then drawn at 130° C. at a draw ratio of 3.3 were subjected to the same heat treatment as described above. The properties of these fibers are also shown in Table 3.

From Table 3 it can be understood that the fibers having been obtained at a spinning speed of 4000 m/min. or more and then heat-treated at 240° C. for 0.7 second at 2% extension are rendered easily dyeable and are excellent in color fastness and fully satisfactory in mechanical properties and thermal stability. In contrast, the fiber having been obtained at a spinning speed of 3000 m/min. and then heat-treated under the above described conditions is rendered easily dyeable but is poor in mechanical properties, and the fiber having been obtained at a spinning speed of 1500 m/min., drawn at a draw ratio of 3.3 and then heat-treated under the above described conditions is not rendered easily dyeable.

TABLE 3

| Run No. | Spinning Speed (m/min.) | Draw Ratio*1 | Dynamic Viscoelastic Properties $T_{max}$ (°C.) | $(\tan\delta)_{max}$ (–) | $\tan\delta_{220}$ (–) | $E'_{30}$ (g/d) | Refractive Index $\Delta n$ ($\times 10^{-3}$) | $n_{\parallel}(0)$ (–) | Distribution of Local Refractive Index | $T_{min}$*3 (°C.) | $T_{m2}/T_{m3}$*3 (°C./°C.) |
|---|---|---|---|---|---|---|---|---|---|---|---|
| 1 | 9000 | — | 97 | 0.141 | 0.018 | 76 | 117 | 1.693 | symmetry | 227 | 269/298 |
| 2 | 8000 | — | 96 | 0.144 | 0.020 | 77 | 118 | 1.692 | " | 225 | 268/297 |
| 3 | 7000 | — | 94 | 0.149 | 0.022 | 79 | 115 | 1.690 | " | 220 | 262/293 |
| 4 | 6000 | — | 95 | 0.169 | 0.032 | 80 | 114 | 1.681 | " | 216 | 259/288 |
| 5 | 5000 | — | 97 | 0.198 | 0.044 | 80 | 89 | 1.670 | " | 214 | 254/283 |
| 6 | 4000 | — | 98 | 0.213 | 0.054 | 57 | 56 | 1.640 | " | 213 | 255/285 |
| 7*2 | 3000 | — | 90 | 0.319 | 0.063 | 39 | 53 | 1.591 | " | 200 | 259/287 |
| 8*2 | 1500 | 3.3 | 136 | 0.104 | 0.038 | 96 | 180 | 1.690 | unsymmetry | 210 | 263/292 |

| Run No. | Crystal Structure $\chi_c$ (%) | ACS (Å) | CO (%) | Mechanical & Thermal Properties Tenacity (g/d) | Elongation (%) | Shrinkage in Boiling Water (%) | $E'_{220}/E'_{150}$ | Degree of Dye Exhaustion (%) | Color Fastness Light | Rubbing | Sublimation |
|---|---|---|---|---|---|---|---|---|---|---|---|
| 1 | 80 | 77 | 96 | 3.6 | 25 | 1.3 | 0.82 | 96 | 4~5 | 5 | 4~5 |
| 2 | 77 | 66 | 96 | 3.8 | 31 | 1.4 | 0.80 | 95 | 4~5 | 5 | 4~5 |
| 3 | 75 | 59 | 95 | 4.4 | 37 | 2.7 | 0.76 | 94 | 4~5 | 5 | 4 |
| 4 | 71 | 52 | 92 | 4.0 | 45 | 3.0 | 0.74 | 94 | 4~5 | 5 | 4 |

TABLE 3-continued

| | | | | | | | | | | | |
|---|---|---|---|---|---|---|---|---|---|---|---|
| 5 | 52 | 50 | 88 | 3.6 | 58 | 3.2 | 0.71 | 93 | 4~5 | 4~5 | 3~4 |
| 6 | 34 | 42 | 86 | 3.4 | 64 | 4.1 | 0.69 | 92 | 4~5 | 5 | 3 |
| 7*2 | 27 | 26 | 50 | 2.1 | 82 | 32.8 | 0.67 | 84 | 4~5 | 5 | 3 |
| 8*2 | 63 | 18 | 91 | 5.2 | 126 | 7.6 | 0.54 | 46 | 3 | 4~5 | 3 |

*1Stretching ratio at 130° C.
*2Fibers of run Nos. 7 and 8 are outside the scope of this invention.
*3$T_{min}$ and $T_{m2}/T_{m3}$ are values before the heat treatment.

Example 4

The multifilaments of 35d/7f having a $T_{min}$ of 212° C. and $T_{m3}$ of 283° C. prepared by the same procedures as in Example 3 at a spinning speed of 5000 m/min. were subjected to heat treatment by passing through a heater for heat treatment 9 as shown in FIG. 1 whose internal surface temperature was adjusted at a temperature shown in Table 4 for 0.8 second at 1% extension without any contact with the surface of the heater. The dynamic viscoelastic properties, mechanical and thermal properties and degree of dye exhaustion of the fiber thus obtained are shown in Table 4. The $\Delta n$ and $n_{\parallel}(0)$ of the fibers of this invention were $85\times10^{-3}$ to $95\times10^{-3}$ and 1.665 to 1.676, respectively and the distribution of local refractive index was symmetrical.

From Table 4 it can be understood that the fibers heat-treated according to this invention are rendered easily dyeable and have fully satisfactory mechanical and thermal properties.

TABLE 4

| Run No. | Heat Treatment Temperature (°C.) | Dynamic Viscoelastic Properties $T_{max}$ (°C.) | $(\tan\delta)_{max}$ (−) | $\tan\delta_{220}$ (−) | $E'_{30}$ (g/d) | Mechanical & Thermal Properties Tenacity (g/d) | Elongation (%) | Shrinkage in Boiling Water (%) | $E'_{220}/E'_{150}$ | Degree of Dye Exhaustion (%) |
|---|---|---|---|---|---|---|---|---|---|---|
| 1*1 | 200 | 130 | 0.150 | 0.043 | 65 | 3.6 | 78 | 9.1 | 0.65 | 45 |
| 2 | 225 | 99 | 0.170 | 0.042 | 76 | 3.6 | 60 | 3.2 | 0.69 | 93 |
| 3 | 250 | 93 | 0.215 | 0.042 | 72 | 3.6 | 52 | 2.1 | 0.75 | 95 |
| 4 | 275 | 91 | 0.250 | 0.050 | 70 | 3.5 | 45 | 1.3 | 0.68 | 93 |
| 5 | —*2 | 134 | 0.195 | 0.047 | 60 | 3.6 | 83 | 13.1 | 0.65 | 56 |

*1Fiber of Run No. 1 is outside the scope of this invention.
*2Fiber without heat treatment.

Example 5

The multifilaments of 35d/7f having a $T_{min}$ of 230° C. and a $T_{m3}$ of 298° C. prepared by the same procedures as in Example 3 at a spinning speed of 9000 m/min. were subjected to heat treatment by passing through a heater for heat treatment 9 as shown in FIG. 1 whose internal surface temperature was adjusted at a temperature shown in Table 5 for 1 second at 1% extension without any contact with the surface of the heater. The dynamic viscoelastic properties, mechanical and thermal properties and degree of dye exhaustion of the fibers thus obtained are shown in Table 5. The $\Delta n$ and $n_{\parallel}(0)$ of the fibers of this invention were $109\times10^{-3}$ to $116\times10^{-3}$ and 1.694 to 1.701, respectively and the distribution of local refractive index was symmetrical.

According to this invention, polyethylene terephthalate fibers can be rendered easily dyeable without accompanying deterioration of mechanical and thermal properties.

TABLE 5

| Run No. | Heat Treatment Temperature (°C.) | Dynamic Viscoelastic Properties $T_{max}$ (°C.) | $(\tan\delta)_{max}$ (−) | $\tan\delta_{220}$ (−) | $E'_{30}$ (g/d) | Mechanical & Thermal Properties Tenacity (g/d) | Elongation (%) | Shrinkage in Boiling Water (%) | $E'_{220}/E'_{150}$ | Degree of Dye Exhaustion (%) |
|---|---|---|---|---|---|---|---|---|---|---|
| 1*1 | 200 | 102 | 0.125 | 0.018 | 76 | 3.5 | 25 | 2.5 | 0.80 | 63 |
| 2*1 | 220 | 101 | 0.124 | 0.018 | 76 | 3.5 | 25 | 2.3 | 0.80 | 69 |
| 3 | 250 | 94 | 0.145 | 0.016 | 78 | 3.6 | 23 | 1.4 | 0.83 | 87 |
| 4 | 270 | 90 | 0.210 | 0.043 | 75 | 3.5 | 28 | 1.4 | 0.81 | 93 |
| 5 | 280 | 89 | 0.215 | 0.050 | 74 | 3.4 | 27 | 1.3 | 0.80 | 94 |
| 6 | —*2 | 102 | 0.126 | 0.018 | 74 | 3.5 | 25 | 2.9 | 0.79 | 60 |

*1Fibers of Run Nos. 1 and 2 are outside the scope of this invention.
*2Fiber without heat treatment.

Example 6

The multifilaments of 35d/7f having a $T_{min}$ of 212° C. and a $T_{m3}$ of 285° C. prepared by the same procedures as in Example 3 at a spinning speed of 4800 m/min. were subjected to heat treatment by passing through a heating device for heat treatment whose internal surface temperature was adjusted at 250° C. for 1.2 seconds at an extension ratio as shown in Table 6 without any contact with the surface of the heating device. The dynamic viscoelastic properties, mechanical and thermal properties and degree of dye exhaustion of the fibers thus obtained are shown in Table 6.

From Table 6 it can be understood that the polyethylene terephthalate fibers heat-treated according to this invention are rendered easily dyeable and have fully satisfactory mechanical and thermal properties.

TABLE 6

| Run No. | Extension Ratio (%) | Dynamic Viscoelastic Properties $T_{max}$ (°C.) | $(\tan\delta)_{max}$ (−) | $\tan\delta_{220}$ (−) | $E'_{30}$ (g/d) | Mechanical & Thermal Properties Tenacity (g/d) | Elongation (%) | Shrinkage in Boiling Water (%) | $E'_{220}/E'_{150}$ | Degree of Dye Exhaustion (%) |
|---|---|---|---|---|---|---|---|---|---|---|
| 1*[1] | −30 | 101 | 0.238 | 0.056 | 45 | 2.9 | 82 | 1.1 | 0.67 | 68 |
| 2 | −15 | 104 | 0.214 | 0.055 | 71 | 3.2 | 78 | 1.5 | 0.75 | 82 |
| 3 | −5 | 105 | 0.195 | 0.049 | 80 | 3.3 | 52 | 2.4 | 0.76 | 94 |
| 4 | 0 | 107 | 0.190 | 0.045 | 83 | 3.4 | 47 | 2.4 | 0.79 | 93 |
| 5 | +4 | 109 | 0.183 | 0.042 | 85 | 3.5 | 30 | 3.2 | 0.81 | 85 |

*[1]Fiber of Run No. 1 is outside the scope of this invention.

Example 7

Polyethylene terephthalate having an intrinsic viscosity [η] of 0.62 dl/g was extruded from a nozzle having 36 fine holes 0.35 mm in diameter at a spinning temperature of 295° C. The filaments extruded were cooled and solidified with a stream of air at 20° C. supplied from the direction of all the circumference of the fiber in the parallel direction of the running filaments and then, after adding an oiling agent, the filaments were wound three times on a pair of take up rollers 7 as shown in FIG. 2 whose surface velocity was shown in Table 7 and whose surface temperature was adjusted at most at 35° C., and then the filaments wound on the take up rollers 7 were subjected to heat treatment by five times winding the filaments on a pair of heating rollers 12 as shown in FIG. 2 whose surface temperature was adjusted at 250° C. and subsequently the filaments thus heat-treated were wound on a winding roller 13 as shown in FIG. 3 to give filaments of 75d/36f. In this heat treatment the extension ratio of the filaments between the take up rollers 7 and the heating rollers 12 was controlled at 3% and the extension ratio of the filaments between the heating rollers 12 and the take up rollers 13 was controlled at 1%. The period of time in which the running filaments contacted with the heating rollers is also shown in Table 7.

The features of the fine structure and the properties of the polyethylene terephthalate fiber thus obtained are shown in Table 7. It is observed that the distribution of local refractive index tends to become unsymmetrical with increased spinning speeds. The fibers produced at a spinning speed of 5500 m/min. had a symmetrical distribution of local refractive index.

TABLE 7

| | Run No. 1*[1] | 2 | 3 |
|---|---|---|---|
| Spinning Speed (m/min.) | 3000 | 4500 | 5500 |
| Period of Time for Heat Treatment (second) | 0.09 | 0.06 | 0.05 |
| Dynamic Viscoelastic | | | |
| $T_{max}$ (°C.) | 92 | 97 | 96 |
| $(\tan\delta)_{max}$(−) | 0.322 | 0.203 | 0.181 |
| $\tan\delta_{220}$(−) | 0.058 | 0.047 | 0.038 |
| $E'_{30}$ (g/d) | 40 | 62 | 81 |
| Mechanical & Thermal Properties | | | |
| Tenacity (g/d) | 2.3 | 3.5 | 3.7 |
| Elongation (%) | 81 | 58 | 51 |
| Shrinkage in Boiling Water (%) | 30.3 | 4.0 | 3.1 |
| $E'_{220}/E'_{150}$ | 0.63 | 0.70 | 0.71 |
| Degree of Dye Exhaustion (%) | 80 | 92 | 91 |

*[1]Fiber of Run No. 1 is outside the scope of this invention.

As is clear from Table 7, when polyethylene terephthalate is obtained at a spinning speed of 4500 m/min. or 5500 m/min. and then heat-treated by using a pair of heating rollers which are conventionally employed in a spin-drawing machine, the present invention can be conducted in one step where the spinning and the subsequent heat treatment are continuously combined.

Example 8

The multifilaments prepared by the same procedures as in Example 2 at a spinning speed of 3000 m/min. and 4000 m/min. were subjected to heat treatment by using an apparatus for heat treatment as shown in FIG. 1 at 250° C. for 0.9 second at −1% extension. Then the multifilaments thus heat-treated were subjected to drawing by a draw twister at a drawing temperature of 100° C. at a draw ratio of 1.1.

The properties of the polyethylene terephthalate fibers before or after stretching are shown in Table 8.

TABLE 8

| | Spinning Speed (m/min.) 3000 | | 4000 | |
|---|---|---|---|---|
| Drawing | no | yes | no | yes |
| Dynamic Viscoelastic Properties | | | | |
| $T_{max}$ (°C.) | 90 | 91 | 98 | 98 |
| $(\tan\delta)_{max}$ (−) | 0.320 | 0.301 | 0.214 | 0.212 |
| $\tan\delta_{220}$ (−) | 0.063 | 0.060 | 0.044 | 0.043 |
| $E'_{30}$ (g/d) | 39 | 45 | 58 | 70 |
| Mechanical Properties | | | | |
| Tenacity (g/d) | 2.1 | 2.4 | 3.4 | 3.8 |
| Elongation (%) | 83 | 70 | 60 | 48 |
| Degree of Dye Exhaustion (%) | 84 | 83 | 91 | 90 |

As is seen from Table 8, after drawing stretching, the fibers prepared at a spinning speed of 3000 m/min. and 4000 m/min. are increased in tenacity and decreased in elongation. However, with the fibers prepared at a spinning speed of 3000 m/min., even if drawn after heat treatment, the $E'_{30}$ is less than 55 g/d, the tenacity is less than 3 g/d and the elongation is as much as 70%. Thus, these fibers are inadequate for use in forming clothing. In contrast to this, when the fiber prepared at a spinning speed of 4000 m/min. is heat-treated according to this invention and then drawn, the properties of the resulting fiber is further improved and in addition, the degree of dye exhaustion is high and the fiber is dyeable under normal pressure.

Example 9

Polyethylene terephthalate having an intrinsic viscosity [η] of 0.63 dl/g was extruded from a nozzle having 7 fine holes 0.35 mm in diameter at a spinning temperature of 300° C. The filaments extruded were cooled and solidified with a stream of air at 22° C. supplied from the direction of all the circumference of the fiber in the parallel direction of the running filaments and then, after adding an oiling agent, the filaments were wound at a spinning speed of 4000 m/min. to 9000 m/min. to give multifilaments of 35d/7f. Subsequently the wound multifilaments were subjected to heat treatment by passing the filaments through a heating cylinder 14 in an apparatus for wet heat treatment as shown in FIG. 3 where superheated steam of 239° C. was jetted through slits 15, for 0.6 second at 1% extension. In the heating cylinder 14 the mol fraction of $H_2O$ was 36%.

The features of the fine structure and properties of the polyethylene terephthalate fiber thus obtained are shown in Table 9.

As a reference, the fiber of 35d/7f having been obtained at a spinning speed of 3000 m/min. and the fiber of 35d/7f having been obtained at a spinning speed of 1500 m/min. and then drawn at 130° C. at a draw ratio of 3.3 were subjected to the same wet heat treatment as described above. The properties of these fibers are also shown in Table 9.

From Table 9 it can be understood that the fibers having been obtained at a spinning speed of at least 4000 m/min. and then wet heat-treated at 238° C. for 0.6 second at 1% extension are rendered easily dyeable and are excellent in color fastness and fully satisfactory in mechanical properties and thermal stability. In contrast, the fiber having been obtained at a spinning speed of 3000 m/min. and then wet heat-treated under the above described conditions is rendered easily dyeable but is poor in mechanical properties, and the fiber having been obtained at a spinning speed of 1500 m/min., drawn at a draw ratio of 3.3 and then wet heat-treated under the above described conditions is not rendered easily dyeable.

ture of 298° C. The filaments extruded were cooled and solidified with a stream of air at 20° C. supplied from the direction of all the circumference of the fiber in the parallel direction of the running filaments and then, after adding an oiling agent, the filaments were wound at a spinning speed of 4000 m/min. to 9000 m/min. to give a fiber bundle of 1800d/600f. Then 100 of the fiber bundle was bundled to give a tow of 180000d/60000f and the tow was subjected to wet heat treatment by passing the tow through an apparatus for wet heat treatment as shown in FIG. 4 at 2% extension for 0.9 second using superheated steam of 238° C. where the mol fraction of $H_2O$ was 40%.

The features of the fine structure and properties of the polyethylene terephthalate tow thus obtained are shown in Table 10.

As a reference, the tow of 180000d/60000f having been obtained at a spinning speed of 3000 m/min. and the tow of 180000d/60000f having been obtained at a spinning speed of 1500 m/min. and then drawn at 130° C. at a draw ratio of 3.3 were subjected to the same wet heat treatment as described above. The properties of these tows are also shown in Table 10.

From Table 10 it can be understood that the tows having been obtained at a spinning speed of at least 4000 m/min. and then wet heat-treated at 238° C. for 0.9 second at 2% extension are rendered easily dyeable and are excellent in color fastness and fully satisfactory in mechanical properties and thermal stability. In contrast, the tow having been obtained at a spinning speed of 3000 m/min. and then wet heat-treated under the above described conditions is rendered easily dyeable but the growth of crystals is not sufficient and the thermal stability of fine structure and the mechanical properties are poor, and the tow having been obtained at a spinning speed of 1500 m/min., drawn at a draw ratio of 3.3 and then wet heat-treated under the above described conditions is not rendered easily dyeable.

TABLE 9

| Run No. | Spinning Speed (m/min.) | Draw Ratio*1 | Dynamic Viscoelastic Properties $T_{max}$ (°C.) | $(\tan\delta)_{max}$ (–) | $\tan\delta_{220}$ (–) | $E'_{30}$ (g/d) | Refractive Index $\Delta n$ ($\times 10^{-3}$) | $n_{(0)}$ (–) | Distribution of Local Refractive Index | $T_{min}$*3 (°C.) | $T_{m3}$*3 (°C.) |
|---|---|---|---|---|---|---|---|---|---|---|---|
| 1 | 9000 | — | 99 | 0.145 | 0.020 | 73 | 115 | 1.701 | symmetry | 226 | 298 |
| 2 | 8000 | — | 96 | 0.147 | 0.022 | 72 | 121 | 1.695 | " | 224 | 296 |
| 3 | 7000 | — | 92 | 0.154 | 0.025 | 74 | 115 | 1.694 | " | 221 | 292 |
| 4 | 6000 | — | 94 | 0.170 | 0.032 | 75 | 92 | 1.682 | " | 215 | 289 |
| 5 | 5000 | — | 95 | 0.208 | 0.045 | 76 | 63 | 1.671 | " | 214 | 284 |
| 6 | 4000 | — | 100 | 0.222 | 0.051 | 59 | 36 | 1.650 | " | 212 | 285 |
| 7*2 | 3000 | — | 90 | 0.320 | 0.060 | 37 | 175 | 1.602 | " | 201 | 288 |
| 8*2 | 1500 | 3.3 | 133 | 0.103 | 0.039 | 87 | | 1.692 | unsymmetry | 211 | 293 |

| Run No. | Crystal Structure $X_c$ (%) | ACS (Å) | CO (%) | Mechanical & Thermal Properties Tenacity (%) | Elongation (%) | Shrinkage in Boiling Water (%) | $E'_{220}/E'_{150}$ | Degree of Dye Exhaustion (%) | Color Fastness Light | Rubbing | Sublimation |
|---|---|---|---|---|---|---|---|---|---|---|---|
| 1 | 78 | 76 | 92 | 3.7 | 28 | 1.4 | 0.80 | 92 | 5 | 5 | 4~5 |
| 2 | 76 | 64 | 93 | 3.9 | 30 | 1.5 | 0.78 | 91 | 5 | 5 | 4~5 |
| 3 | 75 | 59 | 92 | 4.2 | 39 | 2.0 | 0.74 | 91 | 5 | 5 | 4 |
| 4 | 69 | 55 | 90 | 4.1 | 46 | 2.5 | 0.74 | 90 | 5 | 4~5 | 4 |
| 5 | 53 | 52 | 88 | 3.8 | 55 | 3.0 | 0.71 | 88 | 5 | 5 | 4 |
| 6 | 41 | 44 | 84 | 3.6 | 60 | 4.1 | 0.69 | 85 | 5 | 5 | 4 |
| 7*2 | 29 | 25 | 50 | 2.7 | 85 | 29.0 | 0.65 | 81 | 4~5 | 5 | 4 |
| 8*2 | 62 | 18 | 87 | 4.9 | 29 | 6.9 | 0.55 | 42 | 3 | 5 | 4~5 |

*1Draw ratio at 130° C.
*2Fibers of Run Nos. 7 and 8 are outside the scope of this invention.
*3$T_{min}$ and $T_{m3}$ are before the heat treatment.

Example 10

Polyethylene terephthalate having an intrinsic viscosity [η] of 0.64 dl/g was extruded from a nozzle having 600 fine holes 0.3 mm in diameter at a spinning tempera-

TABLE 10

| Spinning | Dynamic Viscoelastic Properties | Crystal Structure |
|---|---|---|

TABLE 10-continued

| Run No. | Speed (m/min.) | Draw Ratio*1 | $T_{max}$ (°C.) | $(\tan\delta)_{max}$ (−) | $\tan\delta_{220}$ (−) | $E'_{30}$ (g/d) | $T_{min}$ (°C.) | $T_{m3}$ (°C.) | χc (%) | ACS (Å) | CO (%) |
|---|---|---|---|---|---|---|---|---|---|---|---|
| 1 | 9000 | — | 98 | 0.143 | 0.019 | 75 | 227 | 297 | 79 | 74 | 93 |
| 2 | 8000 | — | 96 | 0.146 | 0.021 | 74 | 223 | 296 | 75 | 63 | 93 |
| 3 | 7000 | — | 93 | 0.153 | 0.024 | 76 | 220 | 292 | 74 | 57 | 91 |
| 4 | 6000 | — | 93 | 0.171 | 0.031 | 77 | 214 | 289 | 68 | 53 | 89 |
| 5 | 5000 | — | 94 | 0.206 | 0.046 | 75 | 213 | 284 | 51 | 50 | 87 |
| 6 | 4000 | — | 98 | 0.215 | 0.053 | 56 | 212 | 284 | 42 | 44 | 82 |
| 7*2 | 3000 | — | 91 | 0.321 | 0.058 | 34 | 200 | 287 | 27 | 24 | 48 |
| 8*2 | 1500 | 3.3 | 132 | 0.105 | 0.038 | 85 | 210 | 292 | 61 | 17 | 87 |

| Run No. | Mechanical & Thermal Properties: Tenacity (g/d) | Elongation (%) | Shrinkage in Boiling Water (%) | $E'_{222}/E'_{150}$ | Degree of Dye Exhaustion (%) | Color Fastness: Light | Rubbing | Sublimation |
|---|---|---|---|---|---|---|---|---|
| 1 | 3.6 | 27 | 1.5 | 0.81 | 93 | 5 | 5 | 4~5 |
| 2 | 3.8 | 29 | 1.7 | 0.78 | 92 | 5 | 5 | 4~5 |
| 3 | 3.9 | 38 | 2.2 | 0.75 | 91 | 5 | 5 | 4 |
| 4 | 3.7 | 49 | 2.6 | 0.74 | 91 | 5 | 5 | 4 |
| 5 | 3.5 | 52 | 3.5 | 0.70 | 89 | 5 | 4~5 | 4~5 |
| 6 | 3.3 | 61 | 4.3 | 0.68 | 86 | 5 | 5 | 4 |
| 7*2 | 2.2 | 88 | 30.5 | 0.64 | 81 | 4~5 | 5 | 4 |
| 8*2 | 4.7 | 30 | 6.9 | 0.54 | 43 | 3 | 5 | 4~5 |

*1Draw ratio at 130° C.
*2Fibers of Run Nos. 7 and 8 are outside the scope of this invention.

Example 11

The tow of 180000d/60000f having a $T_{min}$ of 212° C. and a $T_{m3}$ of 284° C. prepared by the same procedures as in Example 2 at a spinning speed of 4000 m/min. was subjected to wet heat treatment by using an apparatus for wet heat treatment as shown in FIG. 3 in which superheated steam of a temperature as shown in Table 11 was employed, for 0.7 second at −4% extension. In this wet heat treatment the mol fraction of $H_2O$ was 45%. The dynamic viscoelastic properties, mechanical and thermal properties and degree of dye exhaustion ratio of the tow thus obtained are shown in Table 11.

From Table 11 it can be understood that the tows wet heat-treated according to this invention are rendered easily dyeable and have fully satisfactory mechanical and thermal properties.

Example 12

The multifilaments of 35d/7f having a $T_{min}$ of 213° C. and a $T_{m3}$ of 283° C. prepared by the same procedures as in Example 2 at a spinning speed of 4500 m/min. were subjected to wet heat treatment by using an apparatus for wet heat treatment as shown in FIG. 3 where superheated steam of 225° C. was employed, for 0.7 second at an extension ratio as shown in Table 12. In this wet heat treatment the mol fraction of $H_2O$ was 57%. The dynamic viscoelastic properties, mechanical and thermal properties and degree of dye exhaustion of the fiber thus obtained are shown in Table 12.

From Table 12 it can be understood that the polyethylene terephthalate fibers heat-treated according to this invention are rendered easily dyeable and at −30% extension the initial modulus $E'_{30}$ tends to decrease and also at +6% extension the degree of dye exhaustion tends to decrease.

TABLE 11

| Run No. | Wet Heat Treatment Temperature (°C.) | Dynamic Viscoelastic Properties: $T_{max}$ (°C.) | $(\tan\delta)_{max}$ (−) | $\tan\delta_{220}$ (−) | $E'_{30}$ (g/d) | Mechanical & Thermal Properties: Tenacity (g/d) | Elongation (%) | Shrinkage in Boiling Water (%) | $E'_{220}/E'_{150}$ | Degree of Dye Exhaustion (%) |
|---|---|---|---|---|---|---|---|---|---|---|
| 1*1 | 215 | 121 | 0.149 | 0.044 | 64 | 3.7 | 79 | 9.0 | 0.64 | 41 |
| 2 | 225 | 98 | 0.171 | 0.043 | 76 | 3.8 | 59 | 3.1 | 0.68 | 91 |
| 3 | 230 | 97 | 0.214 | 0.042 | 71 | 3.8 | 51 | 2.2 | 0.74 | 92 |
| 4 | 235 | 92 | 0.245 | 0.050 | 71 | 3.7 | 44 | 1.4 | 0.67 | 91 |
| 5*2 | — | 130 | 0.194 | 0.048 | 61 | 3.6 | 82 | 13.0 | 0.64 | 59 |

*1Tow of Run No. 1 is outside the scope of this invention.
*2Tow without wet heat treatment.

TABLE 12

| Run No. | Extension Ratio (%) | Dynamic Viscoelastic Properties: $T_{max}$ (°C.) | $(\tan\delta)_{max}$ (−) | $\tan\delta_{220}$ (−) | $E'_{30}$ (g/d) | Mechanical & Thermal Properties: Tenacity (g/d) | Elongation (%) | Shrinkage in Boiling Water (%) | $E'_{220}/E'_{150}$ | Degree of Dye Exhaustion (%) |
|---|---|---|---|---|---|---|---|---|---|---|
| 1*1 | −30 | 101 | 0.240 | 0.054 | 47 | 2.9 | 75 | 1.1 | 0.68 | 92 |
| 2 | −15 | 104 | 0.213 | 0.053 | 71 | 3.4 | 68 | 1.5 | 0.73 | 90 |
| 3 | 0 | 106 | 0.196 | 0.048 | 82 | 3.5 | 51 | 2.0 | 0.75 | 93 |
| 4 | +4 | 108 | 0.192 | 0.047 | 84 | 3.6 | 45 | 2.4 | 0.77 | 92 |
| 5 | +6 | 111 | 0.121 | 0.041 | 87 | 3.9 | 27 | 3.3 | 0.80 | 72 |

*1Fiber of Run No. 1 is outside the scope of this invention.

Example 13

Polyethylene terephthalate having a [η] of 0.62 dl/g was extruded from a nozzle having 36 fine holes 0.35 mm in diameter at a spinning temperature of 300° C. The filaments extruded were cooled and solidified with a stream of air at 20° C. supplied from the direction of all the circumference of the fiber in the parallel direction of the running filaments and then, after adding an oiling agent, the filaments were wound three times on a take up roller 7 as shown in FIG. 3 whose surface velocity was shown in Table 13 and whose surface temperature was adjusted at most at 35° C., and then the filaments wound were subjected to wet heat treatment by passing the filaments through a heating cylinder for heat treatment 14 as shown in FIG. 3 using superheated steam of 235° C. where the mol fraction of $H_2O$ was 50%. The filaments thus wet heat-treated were wound three times on a pair of derivery rollers 21 as shown in FIG. 3 and subsequently wound on a winding roller 22 as shown in FIG. 3 to give filaments of 75d/36f. In this wet heat treatment the extension ratio of the filaments between the take-up roller 7 and the derivery rollers 21 was controlled at 0.5%. The period of time for wet heat treatment of the filaments, i.e., the period of time in which the filaments were passed through the heating cylinder 14, i.e., the surface velocity of the take-up rollers 7 is also shown in Table 13.

TABLE 13

| | | Run No. | | |
|---|---|---|---|---|
| | | 1*[1] | 2 | 3 |
| Spinning Speed (m/min.) | | 3000 | 4500 | 5500 |
| Period of Time for Wet Heat Treatment (second) | | 0.09 | 0.06 | 0.05 |
| Dynamic Visco-elastic Properties | $T_{max}$(°C.) | 93 | 98 | 97 |
| | $(\tan\delta)_{max}$ (−) | 0.323 | 0.205 | 0.192 |
| | $\tan\delta_{220}$ (−) | 0.060 | 0.048 | 0.040 |
| | $E'_{30}$ (g/d) | 39 | 63 | 80 |
| Mechanical & Thermal Properties | Tenacity (g/d) | 2.4 | 3.8 | 4.0 |
| | Elongation (%) | 82 | 57 | 51 |
| | Shrinkage in Boiling Water (%) | 29.8 | 4.1 | 2.7 |
| | $E'_{220}/E'_{150}$ | 0.63 | 0.71 | 0.72 |
| Degree of Dye Exhaustion (%) | | 80 | 92 | 91 |

*[1]Fiber of Run No. 1 is outside the scope of this invention.

As is clear from Table 13, when the present invention is conducted by spinning polyethylene terephthalate at a spinning speed of 4500 m/min. or 5500 m/min. and continuously, i.e., without winding, subjecting the filaments to wet heat treatment, i.e., by continuously combining the spinning step with the subsequent heat treatment step, the filaments obtained can be rendered easily dyeable.

Example 14

The polyethylene terephthalate filaments of 1800d/600f having a $T_{min}$ of 212° C. and $T_{m3}$ of 281° C. prepared at a spinning speed of 4000 m/min. by the same procedures as in Example 10 were subjected to crimping without wet heat treatment at a temperature of 180° C. or higher and cut into a staple fiber having a length of 76 mm. The staple fiber obtained was stuffed into cans having a number of holes at their side wall at an apparent specific gravity of 2 Kg/m$^3$ and the cans were placed in an autoclave. After the air inside the autoclave was deaerated to a reduced pressure of 15 mmHg by a vacuum pump, superheated steam of 224° C. was blown into the autoclave for one minute, and then the steam inside the autoclave was withdrawn under reduced pressure, and again superheated steam of 224° C. was blown into the autoclave for one minute and the fiber was taken out of the autoclave.

The properties of the polyethylene terephthalate fibers before and after wet heat treatment are shown in Table 14.

As is clear from Table 14, the $E'_{30}$ and the tenacity with the fiber not wet heat-treated are low and at the same time, the degree of dye exhaustion is low. On the other hand, the fiber wet heat-treated according to this invention has mechanical properties sufficient for practical purposes such as an $E'_{30}$ of more than 55 g/d, a tenacity of more than 3 g/d, an elongation of less than 60% and a degree of dye exhaustion of more than 80%, and is rendered dyeable under normal pressure.

TABLE 14

| Wet Heat Treatment | | no | yes |
|---|---|---|---|
| Dynamic Visco-elastic Properties | $T_{max}$ (°C.) | 108 | 104 |
| | $(\tan\delta)_{max}$ (−) | 0.290 | 0.211 |
| | $\tan\delta_{220}$ (−) | 0.062 | 0.030 |
| | $E'_{30}$ (g/d) | 34 | 59 |
| Mechanical Properties | Tenacity (g/d) | 2.7 | 3.2 |
| | Elongation (%) | 82 | 53 |
| Degree of Dye Exhaustion (%) | | 65 | 86 |

Example 15

The staple fiber before wet heat treatment as obtained in Example 14 was opened in carding to give a sliver and the sliver was stuffed into the same cans as in Example 14 at an apparent specific gravity of 1.5 Kg/m$^3$ and was subjected to the same wet heat treatment as in Example 14.

The properties of the polyethylene terephthalate fibers before and after wet heat treatment are shown in Table 15.

As is clear from Table 15, the $E'_{30}$, the tenacity and the degree of dye exhaustion of the fiber not wet heat-treated are low. On the other hand, the fiber wet heat-treated according to this invention has mechanical properties sufficient for practical purposes such as an $E'_{30}$ of more than 55 g/d, a tenacity of more than 3 g/d, an elongation of less than 60% and a degree of dye exhaustion of more than than 80%, and is rendered dyeable under normal pressure.

TABLE 15

| Wet Heat Treatment | | no | yes |
|---|---|---|---|
| Dynamic Visco-elastic Properties | $T_{max}$ (°C.) | 110 | 103 |
| | $(\tan\delta)_{max}$ (−) | 0.280 | 0.212 |
| | $\tan\delta_{220}$ (−) | 0.061 | 0.047 |
| | $E'_{30}$ (g/d) | 34 | 60 |
| Mechanical Properties | Tenacity (g/d) | 2.7 | 3.2 |
| | Elongation (%) | 81 | 51 |
| Degree of Dye Exhaustion (%) | | 64 | 87 |

Example 16

The staple fiber before wet heat treatment as obtained in Example 14 was spun into a spun yarn having a metric count of 40 by the conventional method. This spun yarn was subjected to wet heat treatment by passing the spun yarn through a heating cylinder for heat treatment 14 as shown in FIG. 3 using superheated steam of 230° C. for 1.5 seconds at 1% extension. In this wet heat treatment the mol fraction of $H_2O$ was 60%. The degree of dye exhaustion before and after wet heat treatment was measured and found to be 64% and 88%, respectively.

Example 17

Polyethylene terephthalate having a [η] of 0.62 dl/g was extruded from a nozzle having 600 fine holes 0.35 mm in diameter at a spinning temperature of 300° C. The filament extruded were cooled and solidified with a stream of air at 21° C. supplied from the direction of all the circumference of the fiber in the parallel direction of the running filaments and then, after adding an oiling agent, the filaments were wound at a spinning speed of 4000 m/min. to 9000 m/min. to give a fiber bundle of 1800d/600f. Subsequently the fiber bundle thus obtained were subjected to heat treatment by passing the fiber bundle through a heater for heat treatment as shown in FIG. 1 whose internal temperature was adjusted at 244° C. for 0.9 second at 0% extension without any contract with the surface of the heater.

The features of the fine structure and properties of the polyethylene terephthalate fiber bundle thus obtained are shown in Table 16.

As a reference, the fiber bundle of 1800d/600f having been obtained at a spinning speed of 3000 m/min. and the fiber bundle of 1800d/600f having been obtained at a spinning speed of 1000 m/min. and then drawn at 130° C. at a draw ratio of 3.3 were subjected to the same heat treatment as described above. The properties of these fiber bundles are also shown in Table 16.

From Table 16 it can be understood that the fiber bundle having been obtained at a spinning speed of 4000 m/min. or more and then heat-treated at 244° C. for 0.9 second at 0% extension are rendered easily dyeable and are fully satisfactory in mechanical properties and thermal stability as the starting material for spinning. In contrast, the fiber bundle having been obtained at a spinning speed of 3000 m/min. and then heat-treated under the above described conditions and the fiber bundle having been obtained at a spinning speed of 1000 m/min., drawn at a draw ratio of 3.3 and then heat-treated under the above described conditions are not satisfactory in the above described properties.

Example 18

Polyethylene terephthalate having a [η] of 0.64 dl/g was obtained at a spinning speed of 4500 m/min. in the same manner as in Example 17 to give a fiber bundle of 1800d/600f. Then 100 of the fiber bundle was bundled to give a tow of 180000d/60000f, and the tow was made flat by a comb-shaped guide and subjected to heat treatment by passing the tow through a heater for heat treatment 9 as shown in FIG. 1 whose internal temperature was adjusted at 250° C. for 1 second at −4% extension. The properties of the polyethylene terephthalate fiber bundle before and after heat treatment are shown in Table 17.

TABLE 17

| Properties | | After Heat Treatment | Before Heat Treatment |
|---|---|---|---|
| Dynamic Visco-elastic Properties | $T_{max}$ (°C.) | 96 | 113 |
| | $(\tan\delta)_{max}$ (−) | 0.204 | 0.247 |
| | $\tan 67_{220}$ (−) | 0.039 | 0.061 |
| | $E'_3$ (g/d) | 79.2 | 46.5 |
| Mechanical & Thermal Properties | Tenacity (g/d) | 3.9 | 3.5 |
| | Elongation (%) | 49 | 80 |
| | Shrinkage in Boiling Water (%) | 1.7 | 7.9 |
| Degree of Dye Exhaustion (%) | | 92.8 | 65.8 |

From Table 17 it can be understood that the tow after heat treatment is remarkably rendered easily dyeable and, as a result, dyeable under normal pressure. Also the mechanical properties of the tow are sufficient as a starting material for spinning.

Example 19

Polyethylene terephthalate having a [η] of 0.63 dl/g was extruded from a nozzle having 600 fine holes 0.30 mm in diameter at a spinning temperature of 302° C. The filaments extruded were cooled and solidified with a stream of air at 20° C. supplied from the direction of all the circumference of the fiber in the parallel direction of the running filaments and then, after adding an

TABLE 16

| Run No. | Spinning Speed (m/min.) | Spinning Draw Ratio*1 | Dynamic Viscoelastic Properties $T_{max}$ (°C.) | $(\tan\delta)_{max}$ (−) | $\tan\delta_{220}$ (−) | $E'_{30}$ (g/d) | $T_{min}$ (°C.) | $T_{m3}$ (°C.) | Crystal Structure χc (%) | ACS (Å) | CO (%) |
|---|---|---|---|---|---|---|---|---|---|---|---|
| 1 | 9000 | — | 97 | 0.145 | 0.018 | 74 | 229 | 298 | 80 | 77 | 93 |
| 2 | 8000 | — | 95 | 0.147 | 0.019 | 75 | 225 | 296 | 79 | 66 | 92 |
| 3 | 7000 | — | 92 | 0.154 | 0.021 | 78 | 221 | 293 | 75 | 59 | 92 |
| 4 | 6000 | — | 93 | 0.172 | 0.030 | 81 | 215 | 290 | 69 | 55 | 91 |
| 5 | 5000 | — | 95 | 0.200 | 0.044 | 80 | 214 | 285 | 54 | 52 | 88 |
| 6 | 4000 | — | 98 | 0.209 | 0.050 | 59 | 213 | 284 | 33 | 45 | 84 |
| 7*2 | 3000 | — | 90 | 0.311 | 0.060 | 38 | 201 | 287 | 27 | 24 | 50 |
| 8*2 | 1000 | 3.3 | 132 | 0.102 | 0.035 | 89 | 211 | 291 | 59 | 20 | 88 |

| Run No. | Mechanical & Thermal Properties Tenacity (g/d) | Elongation (%) | Shrinkage in Boiling Water (%) | $E'_{220}/E'_{150}$ | Degree of Dye Exhaustion (%) | Color Fastness Light | Rubbing | Sublimation |
|---|---|---|---|---|---|---|---|---|
| 1 | 3.6 | 28 | 1.3 | 0.81 | 93 | 4~5 | 5 | 4 |
| 2 | 3.9 | 31 | 1.4 | 0.79 | 93 | 4~5 | 5 | 4 |
| 3 | 4.3 | 39 | 1.9 | 0.76 | 92 | 4~5 | 5 | 4 |
| 4 | 4.1 | 44 | 1.9 | 0.74 | 92 | 4~5 | 5 | 4 |
| 5 | 3.7 | 52 | 2.0 | 0.72 | 91 | 4~5 | 5 | 4 |
| 6 | 3.5 | 58 | 2.5 | 0.71 | 92 | 4~5 | 4~5 | 4 |
| 7*2 | 2.2 | 89 | 30.2 | 0.65 | 83 | 4 ~ 4 | 5 | 3 |
| 8*2 | 4.5 | 30 | 4.5 | 0.55 | 44 | 3 | 4~5 | 4~5 |

*1Draw ratio at 130° C.
*2Fibers of Run Nos. 7 and 8 are outside the scope of this invention.

oiling agent, the filaments were wound at a spinning speed of 5500 m/min. to give a fiber bundle of 900d/600f. Subsequently 200 of the fiber bundles thus obtained were bundled to give a tow of 180000d. This tow was subjected to crimping by using a stuffer box by the conventional method and then cut with Gru-Gru cutter at a length of 36 mm to give a staple fiber. Then a spun yarn of a cotton count of 50 was produced by blending on a drawing frame according to the conventional method in such a manner that the weight ratio of the polyethylene terephthalate staple fiber to cotton fiber having an average length of 25.4 mm was 65:35. The blended yarn thus obtained was subjected to heat treatment by passing the blended yarn through an apparatus for dry heat treatment 14 as shown in FIG. 3 whose internal temperature was adjusted at 235° C. for one second at an 0.5% extension without any contact with the surface of the apparatus. The blended yarns before and after the heat treatment were immersed in a Schweitzer's reagent (i.e., a cuprammonium solution) to remove the cotton fiber by dissolution and the degree of dye exhaustion of the polyethylene terephthalate fiber left was measured. As a result, the degree of dye exhaustion of the fiber before the heat treatment was 65% while that after the heat treatment was remarkably improved to 89%.

First heater: 35
Length: 1 m
Temperature: 200° C.
Stabilizing heater: 38
Diameter: 4 m/m $\phi$
Length: 0.6 m
Temperature: 190° C.
Ratio of surface speeds of rollers 37 to rollers 34, i.e., draw ratio: 1.125
Number of twists: 3500 t/m
Linear velocity of rollers 37: 146 m/min.
Take-up ratio: 4.3%
Stabilized feed ratio: 16%

The features of the fine structure and properties of the false twisted polyethylene terephthalate fiber are shown in Table 18.

The false twisted fiber of Run No. 1 has an $E'_{30}$ as low as 40 g/d, poor dimensional stability and excessively high elongation. In addition, the degree of dye exhaustion is 68% and it cannot be said that fiber is dyeable under normal pressure. The degree of dye exhaustion of 80% approximately corresponds to the dyeing at 130° C. at a pressure higher than atmospheric pressure. Accordingly, the false twisted fibers of this invention having a degree of dye exhaustion of at least 80% are dyeable under normal pressure.

TABLE 18

| Run No. | Spinning Speed (m/min.) | Dynamic Viscoelastic Properties $T_{max}$ (°C.) | $(\tan\delta)_{max}$ (−) | $\tan\delta_{220}$ (−) | $E'_{30}$ (g/d) | Crystal Structure $\chi_c$ (%) | ACS (Å) | CO (%) | Mechanical & Thermal Properties Tenacity (g/d) | Elongation (%) | Crimp Retention (%) | $E'_{220}/E'_{150}$ | Degree of Dye Exhaustion (%) |
|---|---|---|---|---|---|---|---|---|---|---|---|---|---|
| 1*[1] | 3000 | 120 | 0.14 | 0.035 | 40 | 35 | 32 | 46 | 2.4 | 71 | 42 | 0.68 | 68 |
| 2 | 4000 | 98 | 0.25 | 0.025 | 58 | 42 | 45 | 84 | 3.7 | 58 | 72 | 0.72 | 84 |
| 3 | 5000 | 102 | 0.16 | 0.024 | 65 | 71 | 52 | 86 | 3.8 | 52 | 75 | 0.74 | 86 |
| 4 | 6000 | 105 | 0.18 | 0.024 | 70 | 76 | 56 | 91 | 4.1 | 45 | 78 | 0.75 | 86 |
| 5 | 7000 | 105 | 0.17 | 0.023 | 74 | 80 | 62 | 94 | 4.3 | 39 | 77 | 0.76 | 86 |
| 6 | 8000 | 104 | 0.159 | 0.021 | 78 | 82 | 66 | 95 | 4.3 | 38 | 74 | 0.77 | 94 |
| 7 | 9000 | 98 | 0.145 | 0.020 | 80 | 84 | 70 | 95 | 4.4 | 36 | 71 | 0.78 | 94 |

| Run No. | Color Fastness Light | Rubbing | Sublimation |
|---|---|---|---|
| 1*[1] | 4~5 | 5 | 3 |
| 2 | 4~5 | 5 | 3~4 |
| 3 | 4~5 | 5 | 4 |
| 4 | 4~5 | 5 | 4 |
| 5 | 4~5 | 5 | 4 |
| 6 | 4~5 | 5 | 4 |
| 7 | 4~5 | 5 | 4 |

*[1]Fiber of Run No. 1 is outside of the scope of this invention.

Example 20

Polyethylene terephthalate having a [η] of 0.63 dl/g was extruded from a nozzle having 7 fine holes 0.35 mm in diameter at a spinning temperature of 300° C. The filament extruded were cooled and solidified with a stream of air at 22° C. supplied from the direction of all the circumference of the fiber in the parallel direction of all the running filaments and then, after adding an oiling agent, the filaments were wound at a spinning speed of 3000 m/min. to 9000 m/min. to give multifilaments of 35d/7f. Subsequently the multifilaments thus obtained were subjected to heat treatment by passing the multifilaments through a heater for heat treatment 9 as shown in FIG. 1 whose internal temperature was adjusted at 250° C.±0.5° C. for 0.6 second at −2% extension without any contract with the surface of the heater.

Then the multifilaments was subjected to false twisting by using an apparatus for false twisting as shown in FIG. 5 under the following conditions:

What is claimed is:

1. A fiber consisting essentially of polyethylene terephthalate capable of being dyed under normal pressure and having an initial modulus at 30° C. of about 55 g/d to about 130 g/d, a relationship between a peak temperature [$T_{max}$ (°C.)] at the peak of a dynamic mechanical loss tangent (tan δ) measured with a frequency of 110 Hz and a peak value of the dynamic mechanical loss tangent [$(\tan\delta)_{max}$] represented by the formula:

$$(\tan\delta)_{max} \geqq 1\times10^{-2}(T_{max}-105)$$

and a $(\tan\delta)_{max}$ of about 0.14 to about 0.30 and a dynamic mechanical loss tangent at 220° C. ($\tan\delta_{220}$) of at most about 0.055.

2. A fiber according to claim 1 not undergoing false twisting and having a $T_{max}$ (°C.) of at most about 105° C. and a $(\tan\delta)_{max}$ of at least about 0.14.

3. A fiber according to claim 2 having a mean birefringence index ($\Delta n$) of about $80\times10^{-3}$ to about $150\times10^{-3}$.

4. A fiber according to claim 1, claim 2 or claim 3 having a degree of crystallinity ($\chi_c$) of at least about 70%, an apparent crystal size at a face of (010) (ACS) of at least about 50 Å and a degree of crystal orientation at a face of (010) (CO) of at least about 90%.

5. A fiber according to claim 2 having a mean refractive index [n || (0)] of at least about 1.65.

6. A fiber according to claim 2 having a local average refractive index distributed symmetrically around the center of the cross section of the fiber.

7. A fiber according to claim 1 undergoing false twisting.

8. A fiber according to claim 7 having a $T_{max}$ (°C.) of at most about 115° C., a $\chi_c$ of at least about 70%, an ACS of at least about 50 Å and a CO of at least about 85%.

9. A fiber according to claim 1 having an initial modulus at 30° both before and after immersion in water at 100° C. for 60 minutes of at least about 55 g/d, a relationship between a dynamic mechanical loss tangent (tan δ) measured with a frequency of 110 Hz and a peak value of the dynamic mechanical loss [$(\tan\delta)_{max}$] represented by the formula:

$$(\tan\delta)_{max} \geqq 1\times10^{-2}(T_{max}-105)$$

and a $(\tan\delta)_{max}$ of at least 0.14.

* * * * *